US009498682B2

(12) United States Patent
Luciano, Jr. et al.

(10) Patent No.: US 9,498,682 B2
(45) Date of Patent: Nov. 22, 2016

(54) RFID EMBEDDED WITHIN INNER CORE OF A MULTI-CORE GOLF BALL

(71) Applicants: Robert A. Luciano, Jr., Reno, NV (US); Warren White, Reno, NV (US); David Grieshaber, Brisbane, CA (US)

(72) Inventors: Robert A. Luciano, Jr., Reno, NV (US); Warren White, Reno, NV (US); David Grieshaber, Brisbane, CA (US)

(73) Assignee: EDGE TECHNOLOGY, Reno, NV (US)

( * ) Notice: Subject to any disclaimer, the term of this patent is extended or adjusted under 35 U.S.C. 154(b) by 563 days.

(21) Appl. No.: 13/655,853

(22) Filed: Oct. 19, 2012

(65) Prior Publication Data

US 2013/0196787 A1 Aug. 1, 2013

Related U.S. Application Data

(63) Continuation-in-part of application No. 13/277,940, filed on Oct. 20, 2011, which is a continuation-in-part of application No. 13/212,850, filed on Aug. 18, 2011, now Pat. No. 8,866,613, and a continuation of application No. 13/212,885, filed on Aug. 18, 2011.

(60) Provisional application No. 61/375,555, filed on Aug. 20, 2010, provisional application No. 61/374,713, filed on Aug. 18, 2010.

(51) Int. Cl.

| | |
|---|---|
| ***A63B 37/00*** | (2006.01) |
| ***A63B 63/00*** | (2006.01) |
| ***A63B 43/00*** | (2006.01) |
| ***A63B 45/00*** | (2006.01) |
| *A63B 69/36* | (2006.01) |
| *A63B 24/00* | (2006.01) |
| *A63B 71/02* | (2006.01) |

(52) U.S. Cl.

CPC ..... *A63B 37/0075* (2013.01); *A63B 37/0003* (2013.01); *A63B 37/0076* (2013.01); *A63B 43/00* (2013.01); *A63B 45/00* (2013.01); *A63B 63/00* (2013.01); *A63B 69/3694* (2013.01); *A63B 2024/004* (2013.01); *A63B 2024/0037* (2013.01); *A63B 2071/025* (2013.01); *A63B 2220/10* (2013.01); *A63B 2220/12* (2013.01); *A63B 2225/15* (2013.01); *A63B 2225/54* (2013.01)

(58) Field of Classification Search

USPC ..... 473/324–350, 351–378

See application file for complete search history.

(56) References Cited

U.S. PATENT DOCUMENTS

| | | | |
|---|---|---|---|
| 3,369,812 A | 2/1968 | McKee | |
| 3,828,353 A | 8/1974 | Majkrzak et al. | |
| 3,889,957 A | 6/1975 | Klabacka | |
| 4,816,836 A | 3/1989 | Lalezari | |

(Continued)

FOREIGN PATENT DOCUMENTS

| | | | |
|---|---|---|---|
| GB | 2446212 A | 6/2006 | |
| GB | 2446212 A * | 8/2008 | ..... A63B 43/00 |

(Continued)

*Primary Examiner* — Alvin Hunter

(74) *Attorney, Agent, or Firm* — Michael A. Kerr; Kerr IP Group, LLC

(57) ABSTRACT

A multi-core golf ball with an RFID tag embedded thereon is described herein. The multi-core golf ball includes a spherical inner core, an RFID tag, an outer core, and a dimpled cover. The RFID tag is positioned to interface with the spherical inner core. The outer core is configured to encapsulate the spherical inner core and the RFID tag. The dimpled cover is further configured to encase the spherical inner core, the RFID tag and the outer core.

17 Claims, 31 Drawing Sheets

(56) References Cited

U.S. PATENT DOCUMENTS

| | | | | |
|---|---|---|---|---|
| 4,979,739 | A | 12/1990 | Allen et al. | |
| 5,102,140 | A | 4/1992 | Vincent | |
| 5,114,155 | A | 5/1992 | Tillery et al. | |
| 5,370,389 | A | 12/1994 | Reising | |
| 5,439,224 | A | 8/1995 | Bertoncino | |
| 5,505,457 | A | 4/1996 | Boylan et al. | |
| 5,513,841 | A | 5/1996 | Takagi | |
| 5,626,531 | A | 5/1997 | Little | |
| 5,674,130 | A | 10/1997 | Egan | |
| 5,743,815 | A | 4/1998 | Helderman | |
| 5,821,525 | A | 10/1998 | Takebayashi | |
| 5,910,057 | A | 6/1999 | Quimby et al. | |
| 5,949,679 | A | 9/1999 | Born et al. | |
| 6,148,271 | A | 11/2000 | Marinelli | |
| 6,322,455 | B1 | 11/2001 | Howey | |
| 6,569,028 | B1 | 5/2003 | Nichols et al. | |
| 6,607,123 | B1 | 8/2003 | Jollifee et al. | |
| 6,620,057 | B1 | 9/2003 | Pirritano et al. | |
| 6,705,942 | B1 | 3/2004 | Crook et al. | |
| 6,974,391 | B2 | 12/2005 | Ainsworth et al. | |
| 6,998,965 | B1 | 2/2006 | Luciano et al. | |
| 7,040,998 | B2 | 5/2006 | Jolliffe et al. | |
| 7,052,391 | B1 | 5/2006 | Luciano, Jr. | |
| 7,056,221 | B2 | 6/2006 | Thirkettle et al. | |
| 7,059,974 | B1 | 6/2006 | Golliffe et al. | |
| 7,118,105 | B2 | 10/2006 | Benevento | |
| 7,160,196 | B2 | 1/2007 | Thirkettle et al. | |
| 7,315,253 | B1 | 1/2008 | Pijanowski et al. | |
| 7,337,965 | B2 | 3/2008 | Thirkettle et al. | |
| 7,540,428 | B2 * | 6/2009 | Baba et al. | 235/492 |
| 7,691,009 | B2 | 4/2010 | Savarese et al. | |
| 7,714,965 | B2 | 5/2010 | Chien et al. | |
| 7,741,965 | B2 * | 6/2010 | Lai | G06K 7/0008 340/505 |
| 7,766,766 | B2 | 8/2010 | Savarese et al. | |
| 7,791,982 | B2 * | 9/2010 | Karr | 367/140 |
| 7,843,334 | B2 * | 11/2010 | Kumagai et al. | 340/539.13 |
| 8,120,540 | B1 | 2/2012 | Armstrong | |
| 8,866,613 | B2 | 10/2014 | Luciano, Jr. | |
| 8,882,606 | B2 * | 11/2014 | Leech et al. | 473/223 |
| 9,370,694 | B2 * | 6/2016 | Luciano, Jr. | A63B 37/0003 |
| 2003/0004005 | A1 | 1/2003 | Ainsworth et al. | |
| 2003/0085619 | A1 | 5/2003 | Strache et al. | |
| 2003/0191547 | A1 | 10/2003 | Morse | |
| 2004/0142766 | A1 * | 7/2004 | Savarese et al. | 473/353 |
| 2004/0214648 | A1 | 10/2004 | Simpson | |
| 2004/0243262 | A1 | 12/2004 | Hofmann | |
| 2005/0051951 | A1 | 3/2005 | Benevento | |
| 2005/0227792 | A1 | 10/2005 | McCreary et al. | |
| 2005/0272496 | A1 | 12/2005 | Reinish et al. | |
| 2005/0282650 | A1 | 12/2005 | Miettinen et al. | |
| 2006/0038730 | A1 | 2/2006 | Parsche | |
| 2006/0105857 | A1 | 5/2006 | Stark | |
| 2006/0122007 | A1 * | 6/2006 | Savarese et al. | 473/351 |
| 2007/0026968 | A1 | 2/2007 | Ratcliffe | |
| 2007/0167247 | A1 | 7/2007 | Lindsay | |
| 2007/0241987 | A1 | 10/2007 | Kish et al. | |
| 2007/0259740 | A1 | 11/2007 | Savarese et al. | |
| 2008/0000364 | A1 * | 1/2008 | Bevirt | 101/35 |
| 2008/0021651 | A1 | 1/2008 | Seeley et al. | |
| 2008/0158072 | A1 | 7/2008 | Logan et al. | |
| 2008/0207357 | A1 | 8/2008 | Savarese et al. | |
| 2009/0017944 | A1 | 1/2009 | Savarese et al. | |
| 2009/0052618 | A1 | 2/2009 | Homanfar et al. | |
| 2009/0253526 | A1 | 10/2009 | Koudele et al. | |
| 2009/0294528 | A1 | 12/2009 | Halbur | |
| 2009/0314423 | A1 | 12/2009 | Savarese et al. | |
| 2010/0201512 | A1 | 8/2010 | Stirling et al. | |
| 2010/0304876 | A1 | 12/2010 | Hohla et al. | |
| 2010/0328038 | A1 | 12/2010 | Kato | |
| 2011/0201437 | A1 | 8/2011 | Fallow et al. | |
| 2012/0052967 | A1 * | 3/2012 | Grieshaber et al. | 473/155 |
| 2012/0096358 | A1 | 4/2012 | Barnes, Jr. | |
| 2012/0205452 | A1 | 8/2012 | Rofougaran | |
| 2012/0208638 | A1 | 8/2012 | Barney et al. | |
| 2012/0255998 | A1 | 10/2012 | Luciano, Jr. | |
| 2012/0255999 | A1 | 10/2012 | Luciano et al. | |
| 2012/0256731 | A1 | 10/2012 | Luciano et al. | |
| 2013/0023210 | A1 | 1/2013 | Rofougaran | |
| 2013/0154176 | A1 | 6/2013 | Oshima | |
| 2013/0165261 | A1 | 6/2013 | Luciano et al. | |
| 2013/0196787 | A1 | 8/2013 | Luciano et al. | |
| 2013/0196788 | A1 * | 8/2013 | Shimizu et al. | 473/371 |

FOREIGN PATENT DOCUMENTS

| | | | |
|---|---|---|---|
| JP | 8224331 | | 9/1996 |
| JP | 2013154176 | A * | 8/2013 |

* cited by examiner

RFID EMBEDDED WITHIN INNER CORE OF A MULTI-CORE GOLF BALL

CROSS REFERENCE

This patent application is a continuation-in-part of Ser. No. 13/277,940 filed on Oct. 20, 2011 and entitled RFID GOLF BALL TARGET SYSTEM AND METHOD which is a continuation-in-part of utility patent application Ser. No. 13/212,850 filed on Aug. 18, 2011 and entitled BALL SEPARATION DEVICE FOR A GOLF RANGE TARGET and is a continuation-in-part of utility patent application Ser. No. 13/212,885 filed on Aug. 18, 2011 and entitled MOVABLE GOLF RANGE TARGET WITH RFID BALL IDENTIFIER; and both patent applications claim the benefit of provisional patent application 61/374,713 filed on Aug. 18, 2010 and entitled MOVABLE GOLF RANGE TARGET WITH RFID BALL IDENTIFIER and claim benefit of provisional patent application 61/375,555 filed on Aug. 20, 2010 and entitled BALL SEPARATION DEVICE FOR A GOLF RANGE TARGET. All patent applications identified above are hereby incorporated by reference.

FIELD

Embodiments relate to an RFID tag that is embedded within an inner core of a multi-core golf ball. More particularly, the multi-core golf ball includes a spherical inner core, an RFID tag, an outer core and a dimpled cover.

BACKGROUND

Multi-core or multi-layer golf balls are high performance golf balls that are designed for low initial spin and higher spin with the irons, among other design factors. For example, these multi-core or multi-layer golf balls can include dual core with soft center and also provide consistent flight and exceptional distance.

Radio Frequency Identification (RFID) tags contain at least two parts: first, an integrated circuit for storing and processing information, modulating and demodulating a radio-frequency (RF) signal, collecting DC power from the incident reader signal, and other specialized functions; and second, an antenna for receiving and transmitting the signal.

Radio Frequency Identification (RFID) tags are capable of uniquely identifying an object via a pre-programmed response when queried by an external radio frequency wave. However, not all RFID tags are the same, as some are equipped with a transponder ID (TID) by the manufacturer. This TID is usually written to a chip at the point of manufacture, and is not alterable. Additionally, some ultra-high-frequency (UHF) tags can store a 64-bit, 96-bit, or 128-bit serial number. These can be read-only or read/write. Others also have blocks of user memory that can be written to and locked, or rewritten over and over.

Signaling between the reader and the tag is done in several different incompatible ways, depending on the frequency band used by the tag. Tags operating on LF and HF frequencies are, in terms of radio wavelength, very close to the reader antenna; less than one wavelength away. In this near field region, the tag is closely coupled electrically with the transmitter in the reader. The tag can modulate the field produced by the reader by changing the electrical loading the tag represents. By switching between lower and higher relative loads, the tag produces a change that the reader can detect. At UHF and higher frequencies, the tag is more than one radio wavelength from the reader and it can backscatter a signal. Active tags may contain functionally separated transmitters and receivers, and the tag need not respond on a frequency related to the reader's interrogation signal.

An RFID system uses RFID tags that are attached to the objects to be identified. In operation, an RFID reader sends a signal to the tag and reads its response. The readers generally transmit their observations to a computer system running RFID software or RFID middleware.

The RFID tag's information is stored electronically in a non-volatile memory. The RFID tag includes a small RF transmitter and receiver. The RFID reader transmits a radio signal to interrogate the tag. The RFID tag receives the message and responds with its identification information.

RFID tags can be passive or active. Tags may either be read-only, having a factory-assigned serial number that is used as a key into a database, or they may be read/write, where object-specific data can be written into the tag by the system user.

Although RFID tags have been used in golf balls previously, there continues to be problems with separation between the antenna portion and the RFID integrated circuit. When the RFID antenna is separated from the RFID integrated circuit, the RFID golf ball cannot be read. Additionally, RFID golf balls appear to have a noticeably different trajectory when struck than a standard golf ball.

SUMMARY

A multi-core golf ball with an RFID tag embedded thereon is described herein. The multi-core golf ball includes a spherical inner core, an RFID tag, an outer core, and a dimpled cover. The RFID tag is positioned to interface with the spherical inner core. The outer core is configured to encapsulate the spherical inner core and the RFID tag. The dimpled cover is further configured to encase the spherical inner core, the RFID tag, and the outer core.

In one embodiment, the spherical inner core includes a molded surface configured to receive the RFID tag. In another embodiment, the spherical inner core has a cavity configured to receive the RFID tag; and the illustrative RFID tag is shaped to conform to the cavity shape. In a further embodiment, a filling material seals empty space within the cavity between the RFID tag and the cavity.

In yet another embodiment, the RFID tag further includes an encapsulated RFID tag that is positioned between the spherical inner core and the outer core. In another RFID tag embodiment, the RFID tag includes an antenna portion having a plurality of stranded wires. The RFID tag may also include an antenna portion disposed on a substrate, in which the substrate is configured to fit into the cavity. The RFID tag may be folded or curled to fit into the cavity, or otherwise shaped to fit into the cavity.

A method for embedding an RFID tag in an inner core of multi-core golf ball is also described. The method is initiated by placing a slug into a mold, in which the mold includes a pattern for forming a spherical inner core configured to receive the RFID tag. The method then proceeds by melting the slug within the mold into the spherical inner core. The RFID tag is then attached to the inner core. The method then proceeds to encapsulate the spherical inner core and the RFID tag with an outer core. The outer core is then encapsulated with a dimpled cover.

In one embodiment, the spherical inner core includes a molded surface configured to receive the RFID tag. Additionally, the spherical inner core includes a cavity configured to receive the RFID tag. The method may also include filling the cavity with a core material.

In one embodiment, the method of placing the RFID tag within the cavity includes curling the RFID tag and placing the rolled RFID tag within the cavity. In another embodiment, placing the RFID tag within the cavity includes folding the RFID tag and placing the folded RFID tag within the cavity.

FIGURES

The illustrative embodiment will be more fully understood by reference to the following drawings which are for illustrative, not limiting, purposes.

Figure 13:
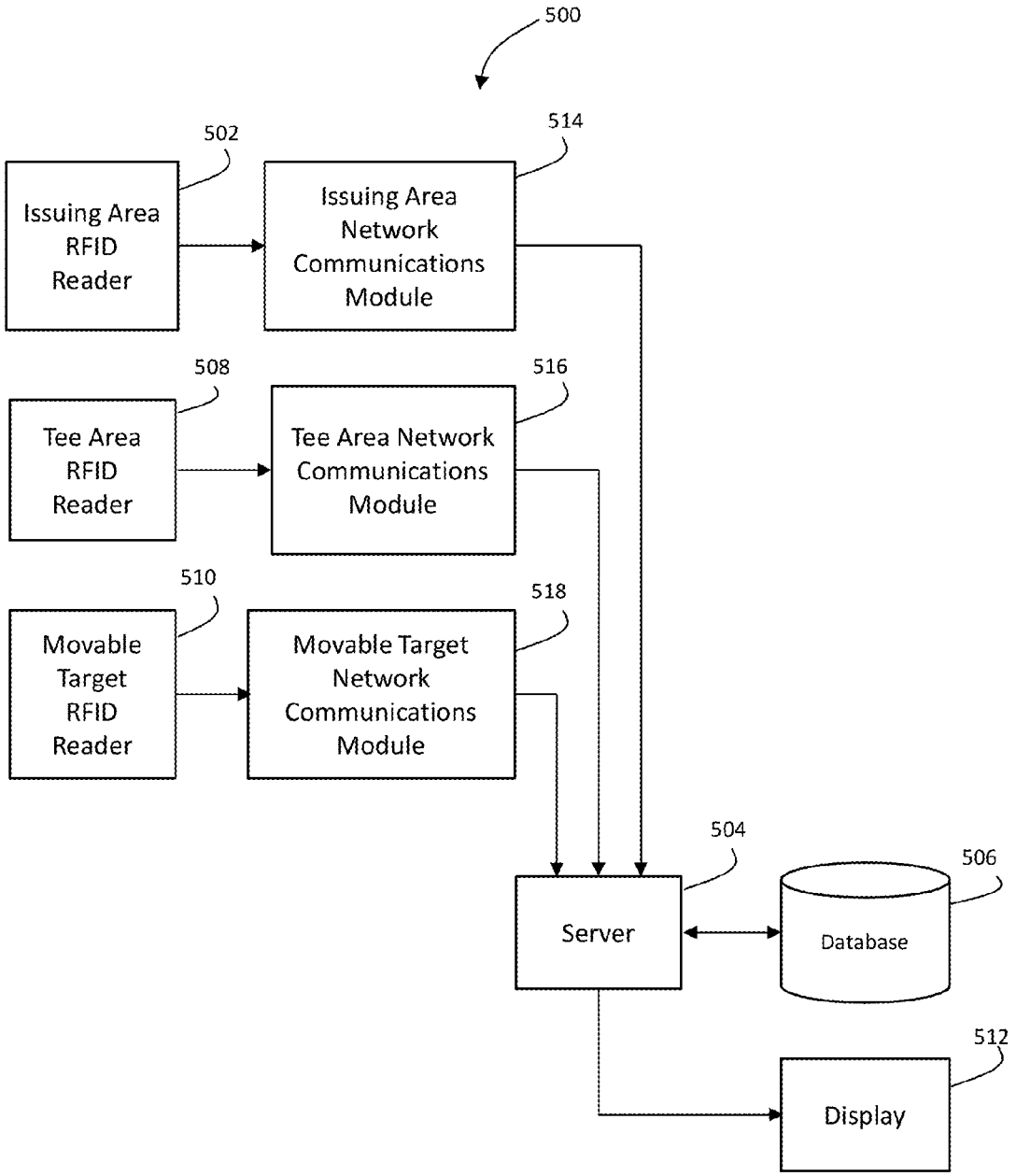

FIG. 13 presents an illustrative system diagram of the golf range target system.

Figure 14:
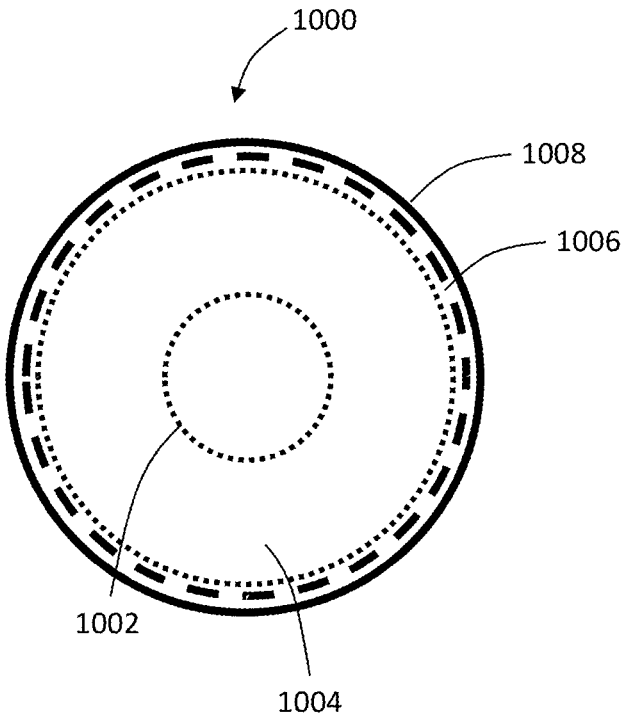

FIG. 14 illustrates a cross-sectional view of a multi-core golf ball in accordance with an embodiment.

Figure 15A:
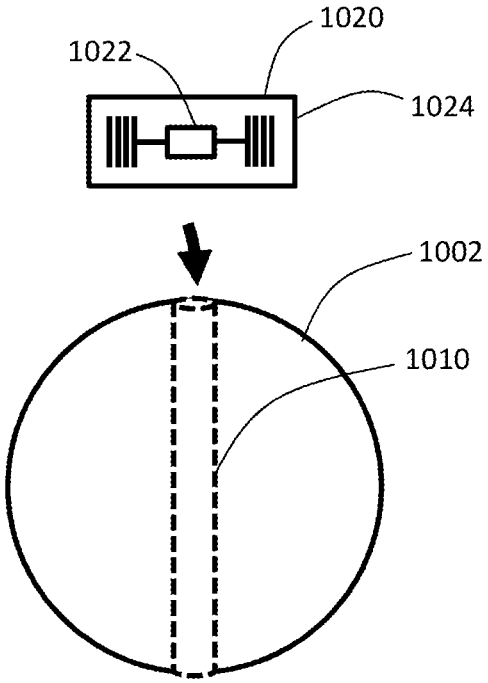

FIG. 15A illustrates a cross-sectional view of the inner core of a multi-core golf ball with a cavity for receiving an RFID tag in accordance with an embodiment.

Figure 15B:
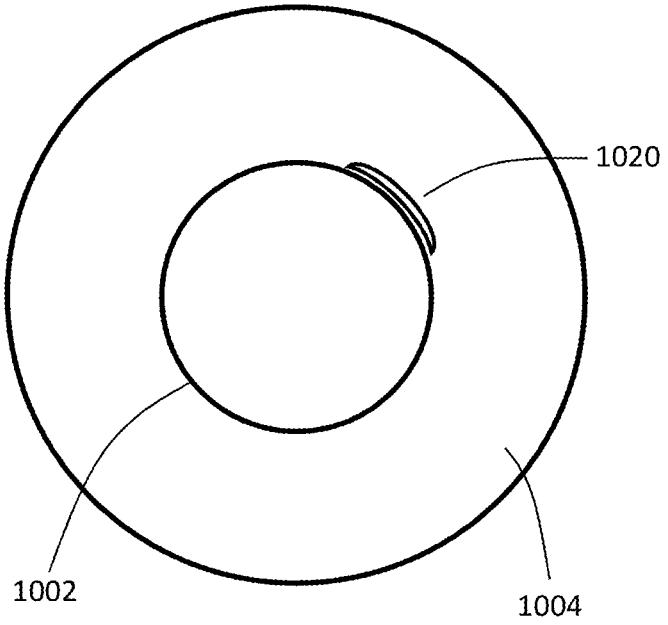

FIG. 15B illustrates a cross-sectional view of the inner core of a multi-core golf ball with an RFID tag interfacing with the exterior surface of the inner core in accordance with an embodiment.

Figure 15C:
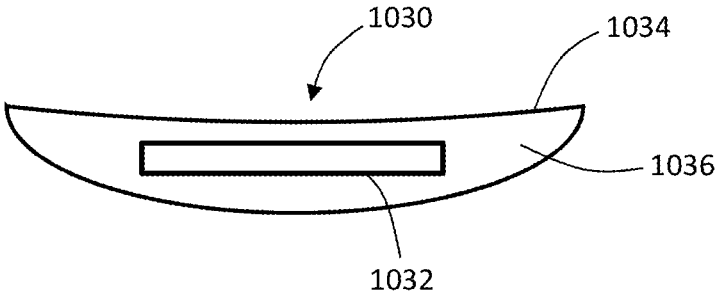

FIG. 15C illustrates a cross-sectional view of an enclosed RFID tag that can be positioned on the exterior surface of the inner core in accordance with an embodiment.

Figure 16A:
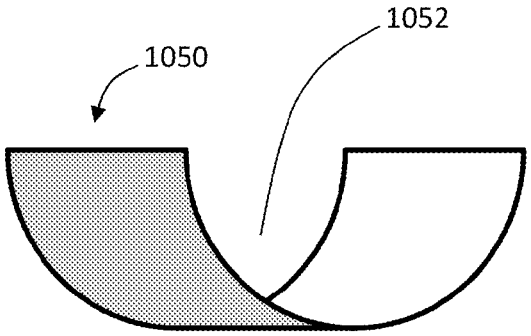
Figure 16B:
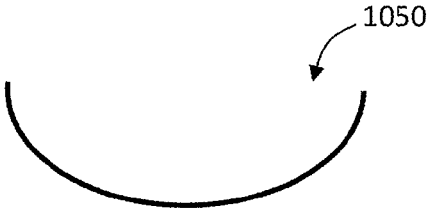
Figure 16C:
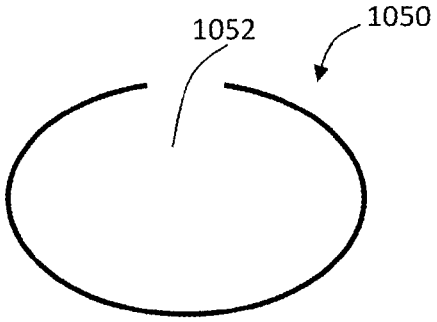

FIGS. 16A-16C illustrate an RFID tag folded into a substantially curved shape in accordance with an embodiment.

Figure 17A:
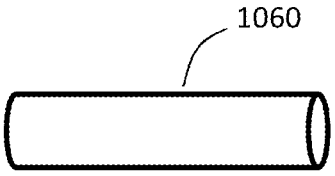
Figure 17B:
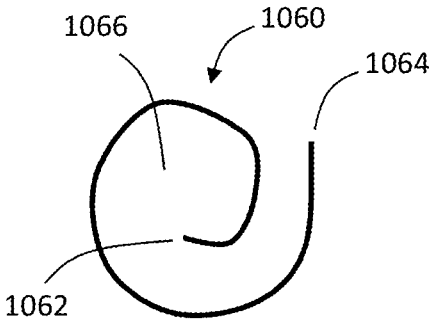
Figure 17C:
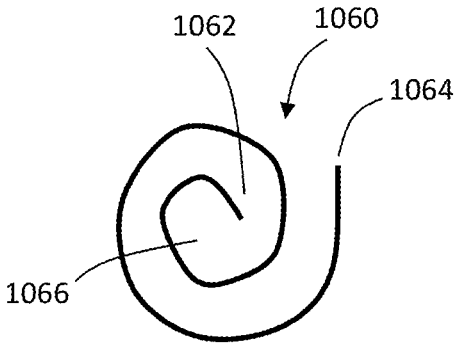

FIGS. 17A-17C illustrate an RFID tag rolled into a substantially cylindrical shape in accordance with an embodiment.

FIGS. 18A-18D illustrate an inner core with differently sized and shaped cavities for receiving the RFID tag in accordance with an embodiment.

FIGS. 19A-19E illustrate a plurality of differently sized and shaped openings for cavities for receiving the RFID tag in accordance with an embodiment.

Figure 20A:
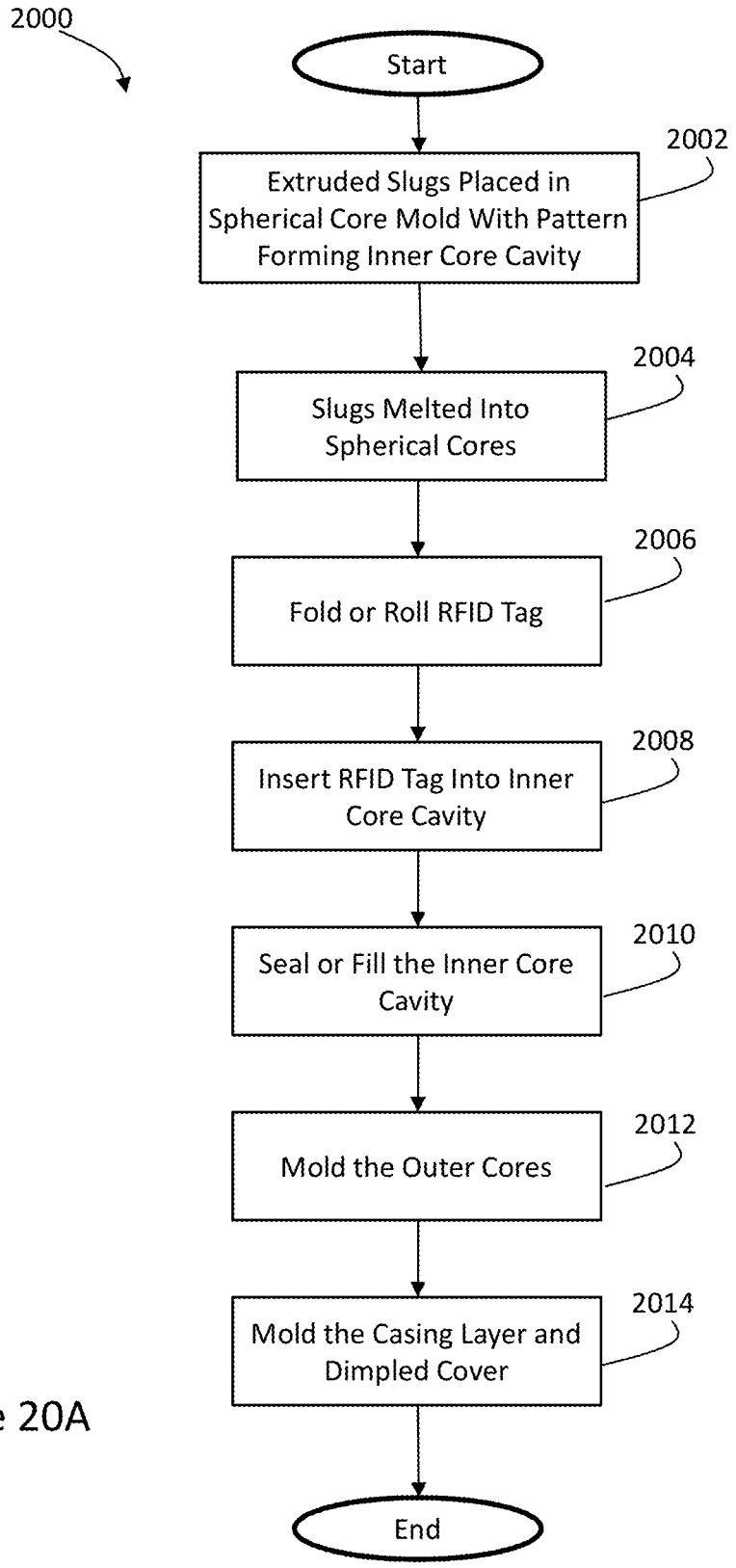
Figure 20B:
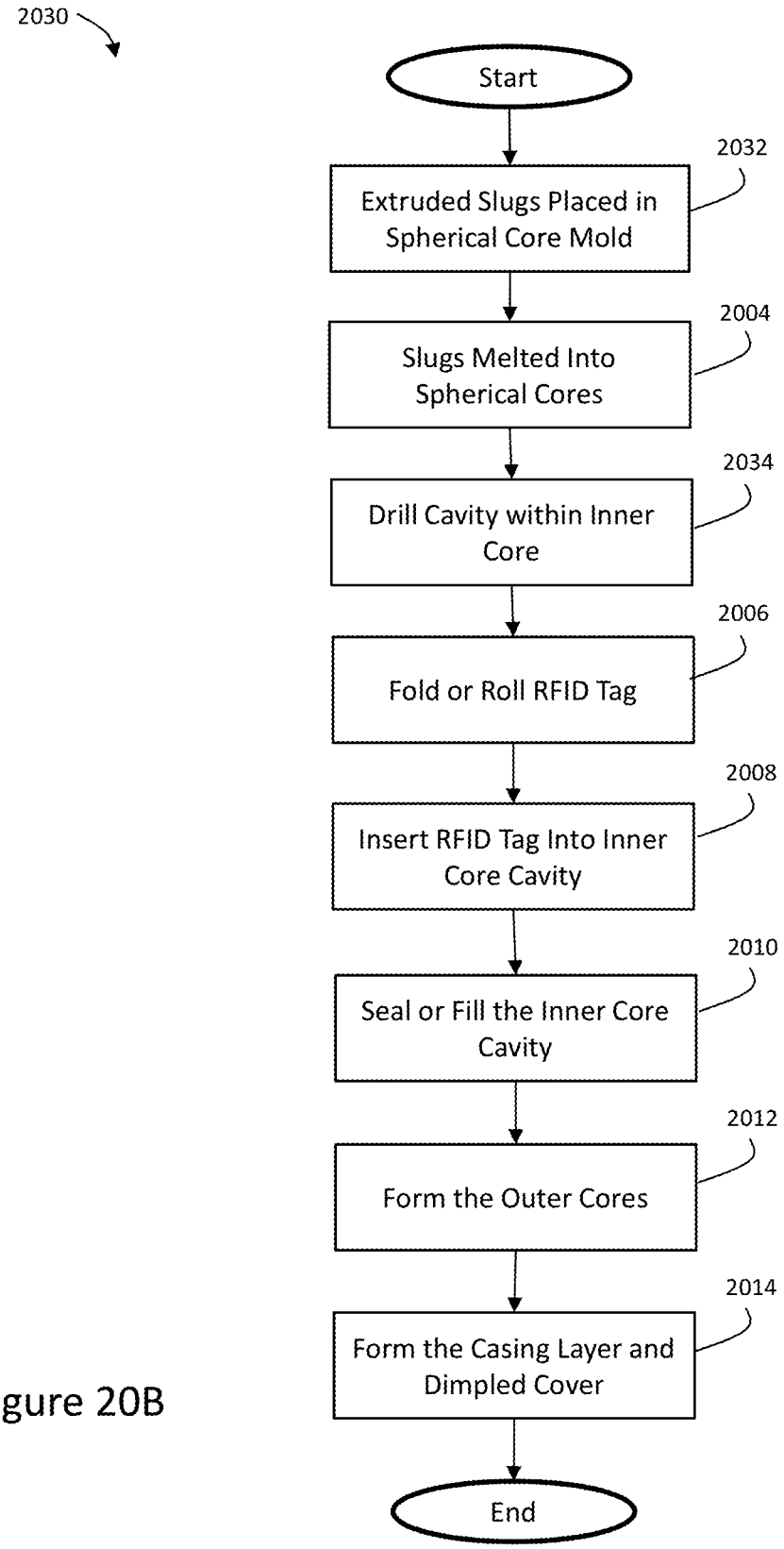

FIGS. 20A and 20B are flowcharts detailing the process of fabricating a multi-core golf ball with an RFID tag embedded within the cavity of the inner core, in accordance with an embodiment.

Figure 21A:
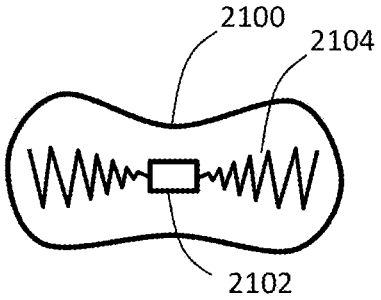
Figure 21B:
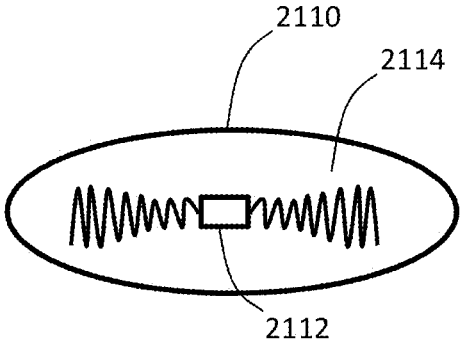
Figure 21C:
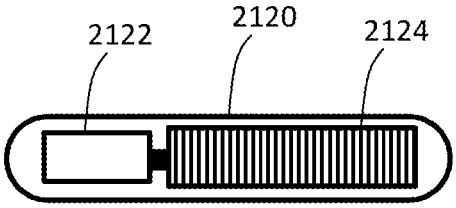

FIGS. 21A-21C illustrate examples of different RFID tags that can be embedded within golf balls in accordance with an embodiment.

FIGS. 22A-22G illustrate various embodiments of an RFID tag embedded within a split inner core of a multi-core golf ball.

Figure 23A:
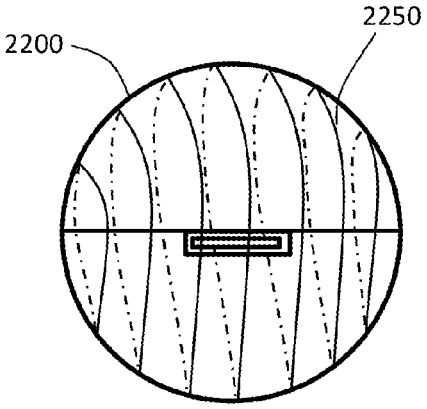
Figure 23B:
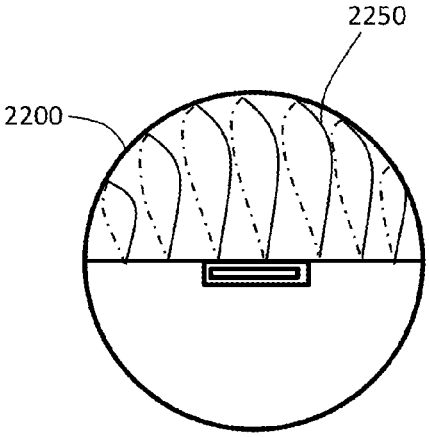
Figure 23C:
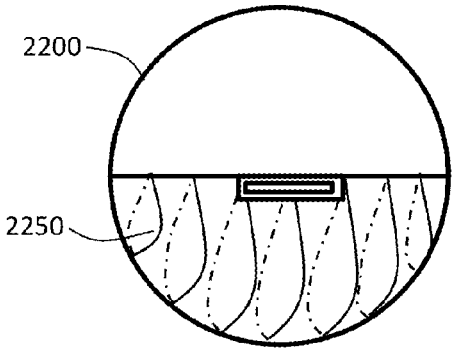

FIGS. 23A-23C illustrate embodiments of an RFID tag embedded within a split inner core, with the conductive wires of the RFID tag wrapped around the exterior surface of the split inner core.

Figure 24:
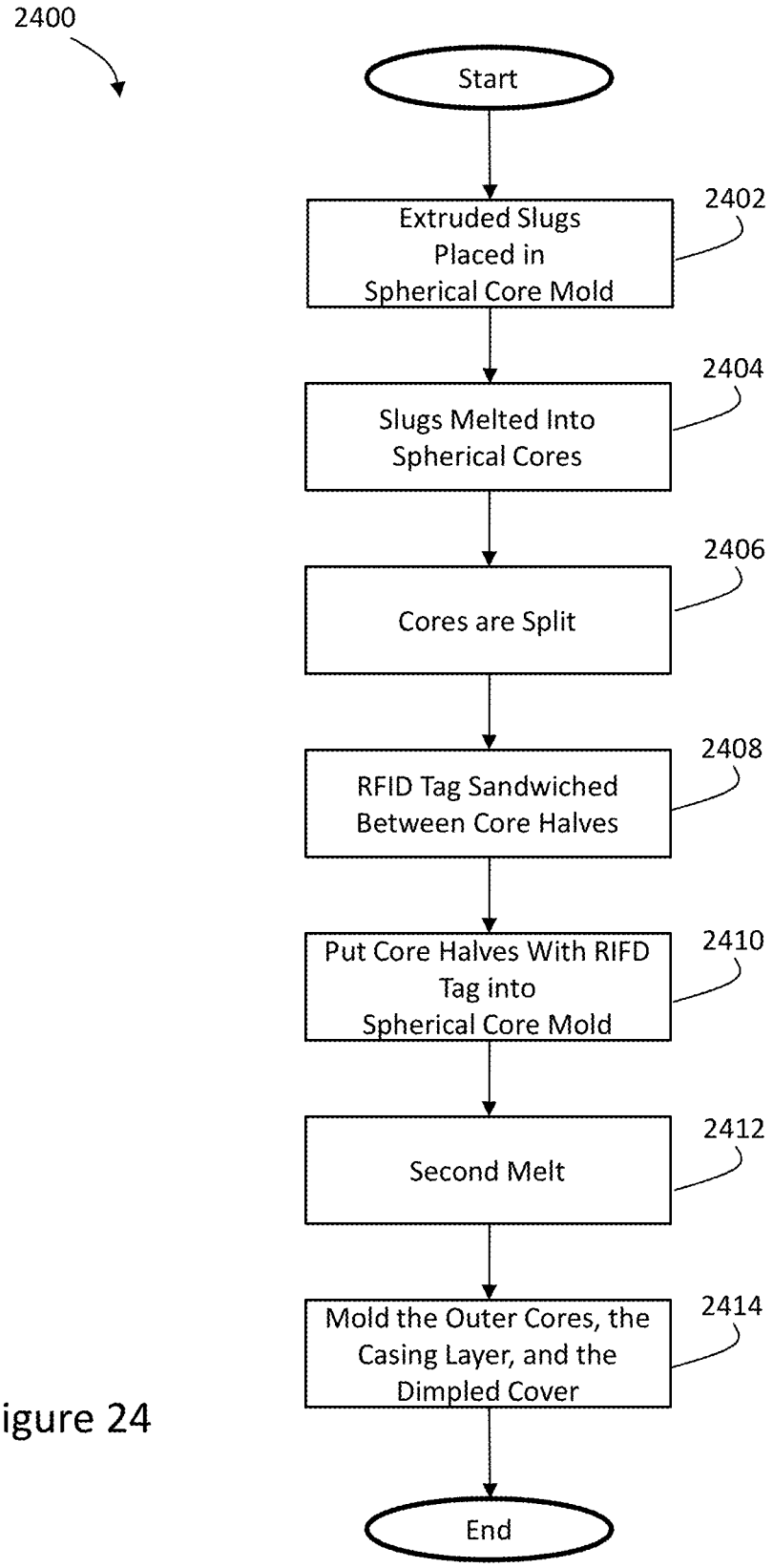

FIG. 24 is a flowchart detailing the process of fabricating a multi-core golf ball with an RFID tag embedded between the hemispheres of a split inner core.

Figure 25A:
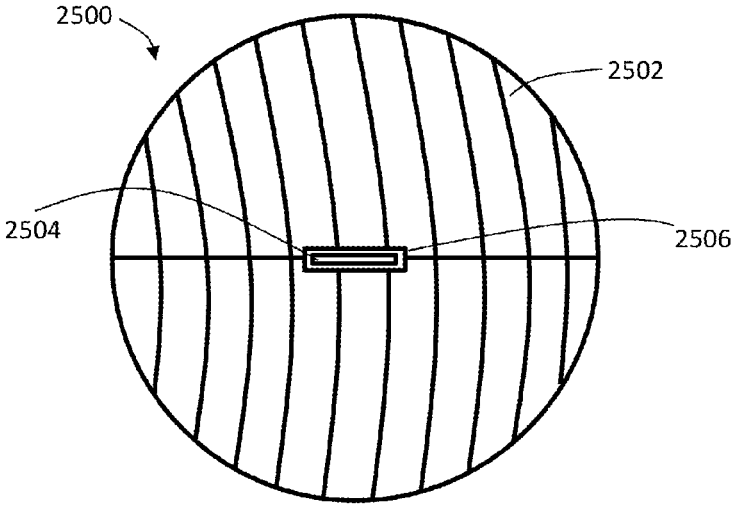
Figure 25B:
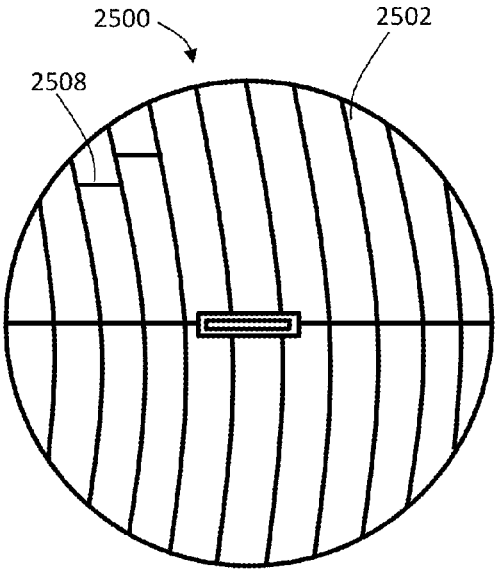
Figure 25C:
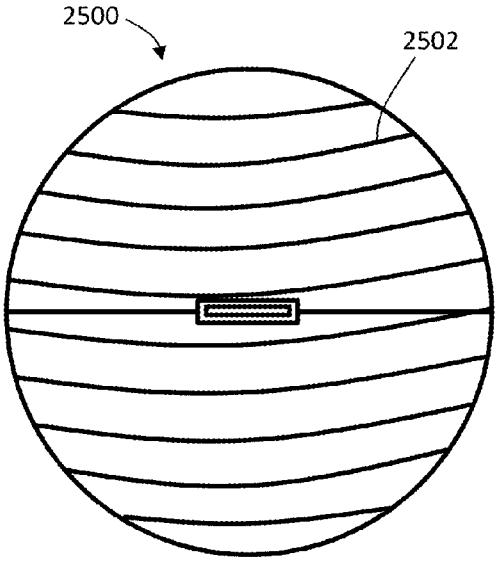

FIGS. 25A-25C illustrate embodiments of an RFID tag embedded within a split inner core, with a plurality of grooves molded on the exterior surface of the split inner core, and with the conductive wires of the RFID tag wrapped along the plurality of grooves.

Figure 26A:
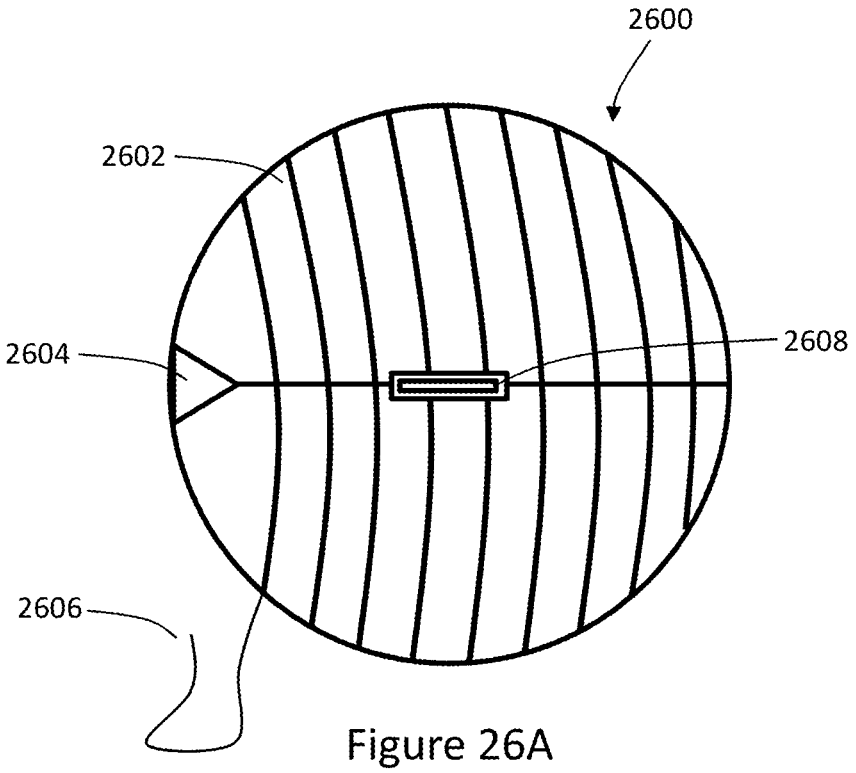
Figure 26B:
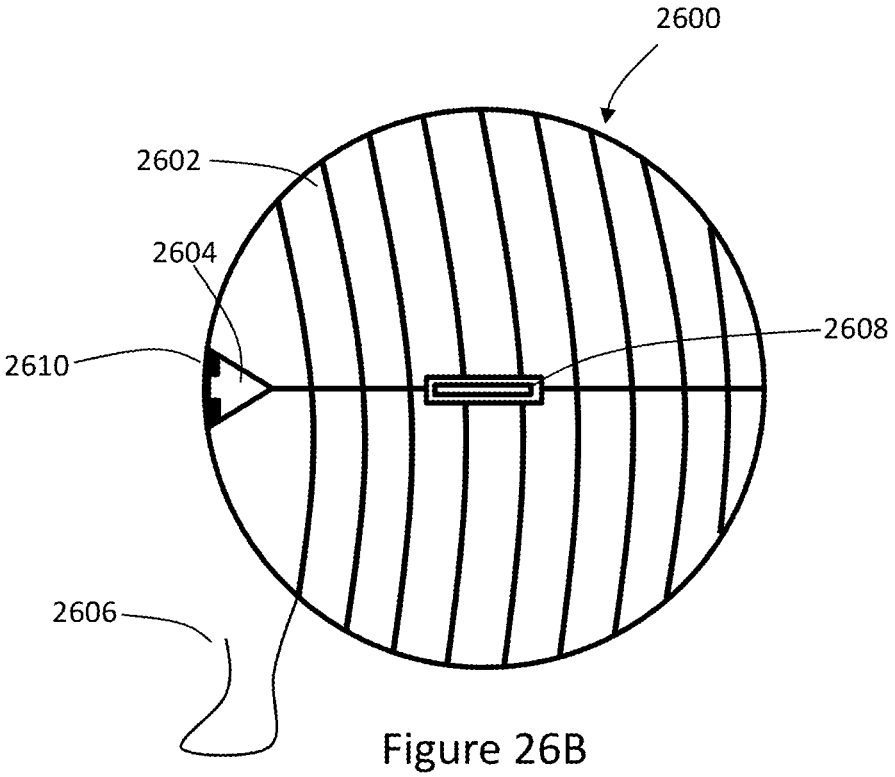

FIGS. 26A and 26B illustrate embodiments of an RFID tag embedded within a split inner core, with a plurality of grooves molded on the exterior surface of the split inner core, with the conductive wires of the RFID tag wrapped along the plurality of grooves, and with a distal end of the conductive wires secured within a termination point molded on the spilt inner core.

DETAILED DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the RFID golf ball systems and methods described hereinafter may vary as to configuration and as to details.

An apparatus and method for integrating an RFID tag into a high performance multi-core golf ball are described herein. Multi-core golf balls are high performance golf balls. For example, these multi-core or multi-layer golf balls can include dual core with soft center and provide consistent flight and exceptional distance. A multi-core golf ball with an RFID tag embedded thereon is described herein. Additionally, a multi-core golf ball having a split inner core with an RFID tag is described.

RFID tags have been used in single core golf balls previously. However, there continue to be problems with separation between the antenna portion and the RFID integrated circuit. When the RFID antenna is separated from the RFID integrated circuit, the RFID golf ball cannot be read. Additionally, RFID golf balls appear to have a noticeably different trajectory than a standard golf ball when struck. The amount of ball flex in a golf ball is estimated to be 0.2 inches during impact, and this impact causes separation between the antenna portion and the RFID integrated circuit, creating an RFID golf ball that cannot be read.

A variety of different RFID golf ball embodiments are presented herein including compressible core with a carrier material having an RFID integrated circuit and antenna, or an encapsulated RFID integrated circuit with conductive wires as antennas. Additionally, RFID golf ball systems and methods are presented. Furthermore, RFID golf ball reader systems are described herein.

For purposes of this patent application, the terms RFID "integrated circuit" is interchange with the term "chip." As described below, the RFID integrated circuit or chip includes a memory that stores at least one unique identifier. The term "identifier" refers to identification numbers or letters or symbols or any combination thereof.

The RFID integrated circuit may be encapsulated in a rigid or elastic material. As described in further detail, the encapsulated RFID integrated circuit includes exposed contact pads that are electrically coupled to an antenna. Illustrative materials for the rigid or elastic encapsulated RFID integrated circuit include an epoxy resin or silicon-based compound, respectively.

Additionally, term "antenna" as used herein refers to either an RFID antenna or an RFID reader antenna. Additionally, the term "antenna" is sometimes used interchangeably with materials that function as an antenna such as "conductive wires" or "conductive ink". The conductive wires or conductive ink are placed on the surface or in the center of the compressible cores.

Conductive wires operate as antennas for the encapsulated RFID integrated circuit described herein. Generally, the conductive wires are electrically coupled to the encapsulated RFID circuit with a solder that joins the surface of the contact pad and the surface of the conductive wire. By way of example and not of limitations, the material properties of the solder may include tin, lead, silver or any combination thereof, Sometimes reference is made to an "RFID tag." The RFID tag includes both a chip and an antenna. The RFID tag may also be referred to as an "RFID inlay" or and "RFID inlay tag."

The RFID tag may also include a "carrier" or "substrate," on which the chip and antenna are disposed. The carrier or substrate may include an adhesive or may not include an adhesive.

Reference is also made to a compressible core. The term "compressible" refers to the ability of the core to be compressed when struck by a golf club. The term "compressible" is thus descriptive and does not depart from the fundamental material properties corresponding to or associated with the "compressible core." For example, basic concepts of stress, strain, and elastic modulus are applicable to the compressible core and its precursor, the "slug." The term "slug" refers to a pillow-shaped material placed inside a mold, and which is heated at a high pressure to produce the compressible core. A compressible core may also be subject to stress such as tensile stress, bulk stress, and shear stress. Additionally, the terminology of "compressed" or "compressible" is also similar to "flexible," and so these terms are also used interchangeably in this patent application.

The "mold" described herein imparts a predominantly spherical shape to the slug material. The compressible core is primarily spherical in shape, but is also shaped to accommodate receiving the RFID chip, RFID antenna, the carrier material, and any other encapsulation materials. Thus, the various configurations of RFID chip and RFID antenna can result in a customized mold. Any gaps or spaces in the customized mold impression may be filled with a fill material. The fill material has material properties similar to the compressible core.

A molded shell is also presented herein as the dimpled shell on a golf ball. The molded shell encapsulated the compressible core.

Various RFID readers are also presented herein. The RFID readers include RFID reader antennas and RFID reader transmitters. Sometimes reference is simply made to transmitter and receiver, without making reference to the RFID reader or RFID tag, because the context enables one with ordinary skill in the art to distinguish between and RFID reader Tx/Rx and the RFID tag Tx/Rx.

The illustrative RFID reader antennas presented herein are generally associated with a golf driving bay in a golf driving range. A golf driving bay is an area that is used by a player for hitting golf balls in a golf driving range. Generally, a golf driving range has a plurality of bays and these bays may be on a ground level or may be stacked on top of one another in a multi-level golf driving range.

Figure 1A:
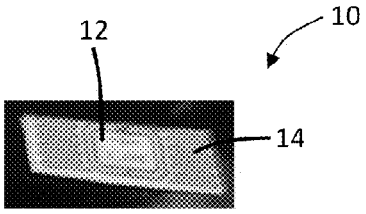
Figure 1A (prior art)
FIG. 1A shows an RFID tag with an inlay.

Referring to FIG. 1A, there is shown and RFID tag inlay 10. The RFID tag generally includes a graphic overlay and an inlay, with the RFID tag inlay being the functional part of the RFID tag 10. The RFID tag inlay 10 includes an RFID integrated circuit (IC) 12 or "chip" that is used to carry the coded information and an antenna 14 that is used to transmit and receive RF signals.

As described in further detail below, the RFID tag 10 is received by an RFID golf ball with a customized molded impression. Additionally, the RFID tag 10 may be disposed between a split core or slug.

In the illustrative embodiment, the RFID tag includes an omnidirectional antenna that operates in the ultra-high-frequency (UHF) range. Additionally, the illustrative RFID tag can be encapsulated in a flexible substrate that is disposed between the spherical golf ball core and a spherical golf ball shell.

By way of example and not of limitation, the illustrative RFID tag 918 operates in the 860 MHz-960 MHz band, and the size of the internal chip is 0.2 mm by 0.2 mm. The illustrative flexible substrate or "carrier" may be composed of PVC, Teslin, urethane or any such flexible material.

Figure 1B:
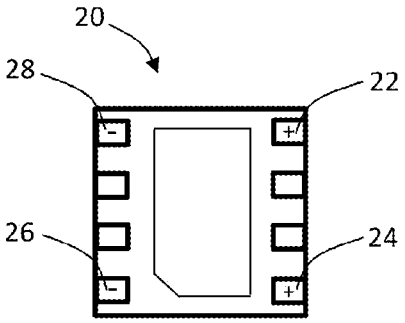
Figure 1B (prior art)
FIG. 1B shows an encapsulated RFID tag with contacts.

An alternative to the RFID tag 10 is the encapsulated RFID tag 20 shown in FIG. 1B. The illustrative encapsulated RFID tag 20 includes contact pads 22, 24, 26 and 28 that are electrically coupled to an antenna (not shown in FIG. 1B). By way of example and not of limitation, the illustrative RFID chip is a Monza 4 Dura chip from Impinj.

The illustrative Monza 4 Dura chip is in a packaged format with a ruggedized tag design that includes the encapsulated RFID chip with a rigid material, e.g. an epoxy. The illustrative Monza 4 Dura is supported by a standard PCB surface mount assembly technique and is encased in an 8-pin μDFN package that accommodates surface mount assembly. The illustrative operating frequency is between 860-960 MHz. The package length is approximately 2 mm, width is 2 mm, and height is 0.50 mm. By way of example and not of limitation, pins 8 and 4 provide input pads for a first antenna that is isolated from the RF input pads for a second antenna that utilizes pins 1 and 5 as the input pads.

Figure 1C:
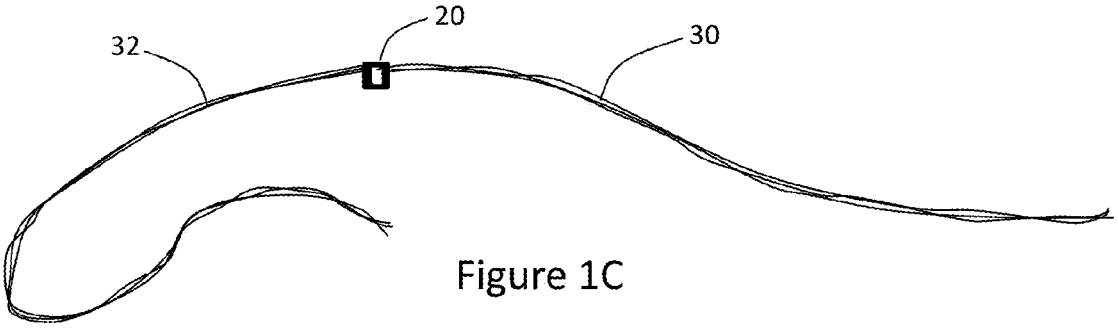
FIG. 1C shows the encapsulated RFID tag with an antenna

FIG. 1C, there is shown the encapsulated RFID integrated circuit with conductive wires that operate as an antenna. In the illustrative embodiment, the Monza 4 Dura chip is integrated with a compressible golf ball core as described herein. More particularly, the encapsulated RFID integrated circuit 20 is coupled to conductive wires 30 that are electrically coupled to contacts 22, 24 and conductive wires 32 are electrically coupled to contacts 26 and 28.

Figure 1D:
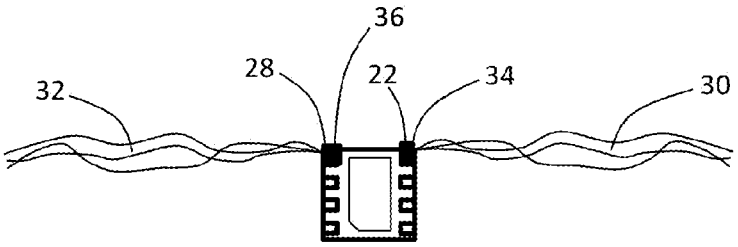
FIG. 1D shows an exploded view of encapsulated RFID tag in FIG. 1C.

FIG. 1D shows an exploded view of encapsulated RFID integrated circuit in FIG. 1C, in which the conductive wires 30 and 32 are electrically coupled to contacts 22 and 28, respectively. The conductive wires 30 and 32 are electrically coupled to contacts 22 and 28 using a material 34 and 36, respectively. The materials 34 and 36 may be either conductive materials, non-conductive materials or a combination thereof. The illustrative encapsulated RFID tag shown in FIGS. 1C and 1D are then integrated into a golf ball as described in further detail below.

Figure 2:
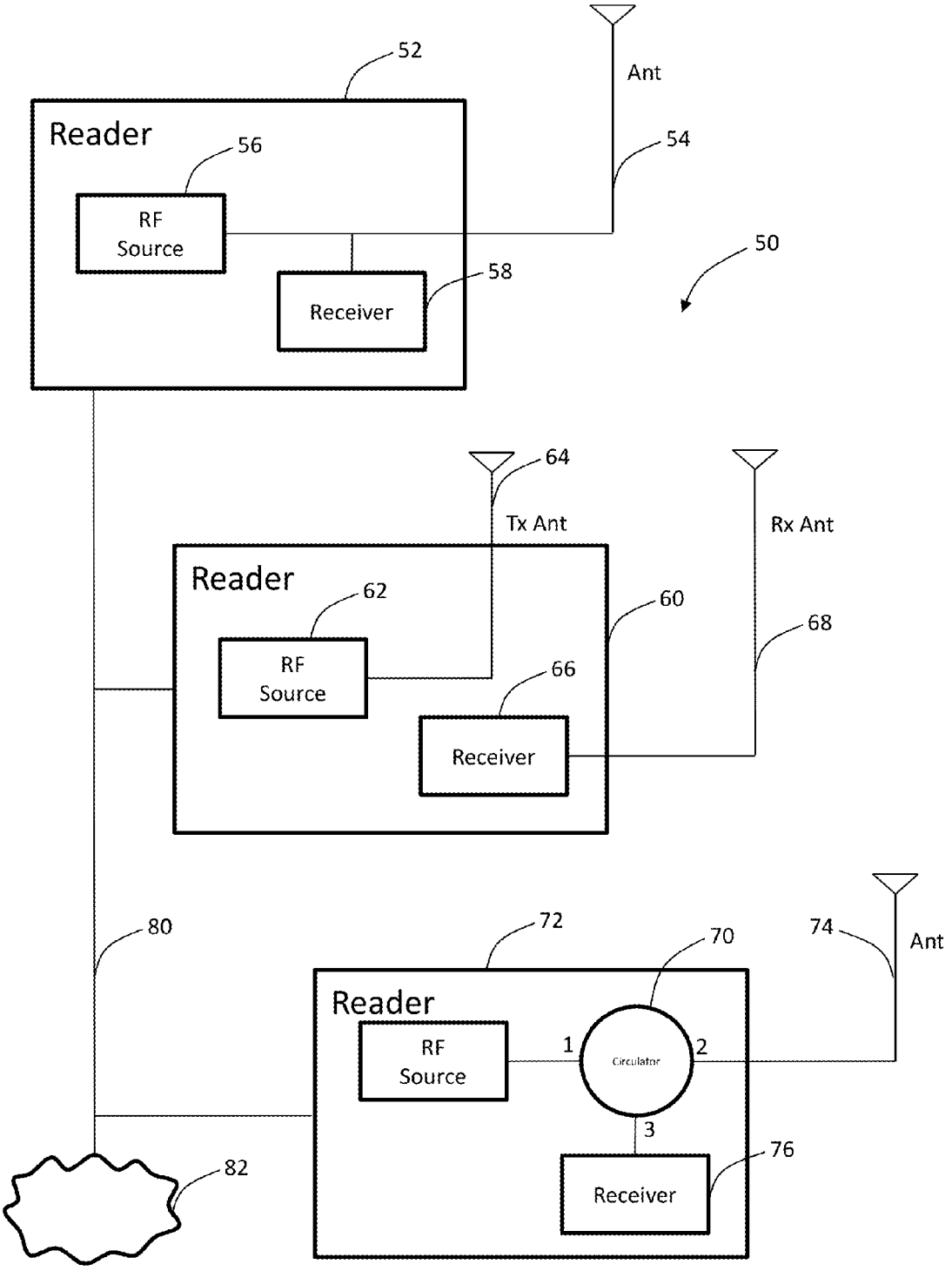
FIG. 2 shows networked RFID readers.

Referring now to FIG. 2, there is shown a plurality of networked RFID readers that interrogate the RFID tags described above. The interrogation is commonly accomplished by arranging the RFID tags to listen for an interrogation message and to respond with a unique serial number or other such information. The RFID tags typically have limited power available for transmitting data wirelessly to the reader.

By way of example and not of limitation, a reader operates in a backscatter mode and the RFID tags operate using the power of the received signal from the reader to transmit. The illustrative reader is configured to have a high transmission power and high sensitivity to backscattered signals from the RFID tags.

Generally, there are two types of reader systems; bistatic systems and monostatic systems. A bistatic system uses different antennas for transmission and reception, and the antennas are sufficiently separated in space to have fewer isolation problems.

A monostatic system uses the same antenna, or colocated antenna, for transmission and reception. When the same antenna is used for both transmission and reception, a monostatic system may use only half of the number of antennas that are used in a bistatic system and cover the same area. However, a monostatic system typically requires lots of tuning to isolate the transmit power and the receiver. In a typical RFID system, the transmit power of a reader may be around a watt or two, while the receiver may be expected to be sensitive to signals at microwatt levels.

Conventional RFID readers are typically designed to use one of three general approaches to transmit signals to and receive signals from one or more tags. These approaches include a single channel homodyne technique, a two-antenna bistatic technique, and a circulator device.

Illustrative RFID reader 52 uses a homodyne receiver. A homodyne receiver refers to a single channel for both the transmitted signal and the received signal and a direct down conversion of the data to baseband. The reader 52 has a single antenna 54 electrically coupled to both a RF source 56 and a receiver 58.

The illustrative reader 60 is a bi-static system with separate antennas that are used for transmit and receive. For example, the RFID reader 60 has a radio frequency source 62 coupled to its transmit antenna 64 and a receiver 66 coupled to receive antenna 68 that receives signals.

A circulator 70 is used to separate the incoming signal (receive) from the outgoing signal (transmit), and couples the powers in a preferred direction so the receiver retains backscatter information and the transmitter powers the tag. For example, the reader 72 includes a circulator 70 that couples power in a preferred direction, forward for transmit and power, and to the receiver 76 for the receive or reflected portion. Power to the tag passes through to the antenna 74, and received power from the RFID tag is channeled toward the receiver block 76 after being reflected by the tag. The circulator 70 couples port 2 to port 1 to transmit signals and couples port 2 to port 3 to receive signals.

The illustrate readers 52, 60 and 72 are communicatively coupled to a network 82 with illustrative Ethernet cables 80.

In one embodiment, the RFID reader of the RFID ball reading system is disposed above ground along a vertical plane. In another embodiment, the RFID reader is disposed along a horizontal plane.

In the illustrative embodiment, each RFID reader is communicatively coupled to a plurality of antennas that correspond to a particular golf driving bay. Additionally, RFID readers are networked and communicate RFID data with a central database.

Additional embodiments for the RFID reader systems are presented in patent application Ser. No. 13/277,940 entitled RFID GOLF BALL TARGET SYSTEM AND METHOD, which is hereby incorporated by reference in its entirety.

Figure 3A:
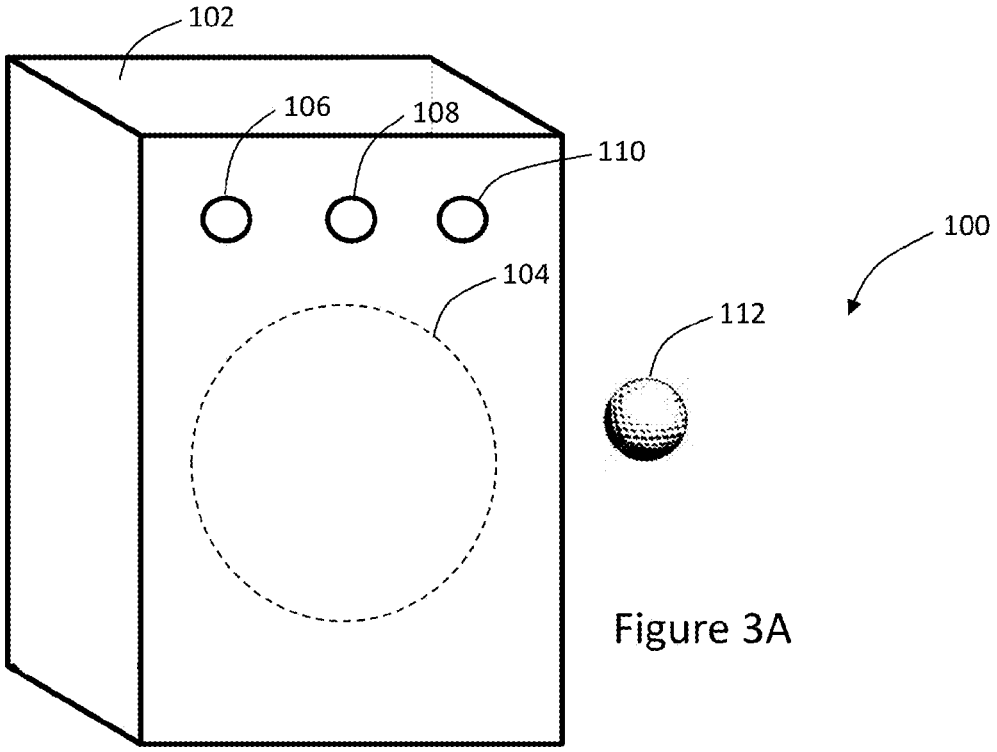
FIG. 3A and FIG. 3B show an RFID reader in a vertical plane.
Figure 3B:
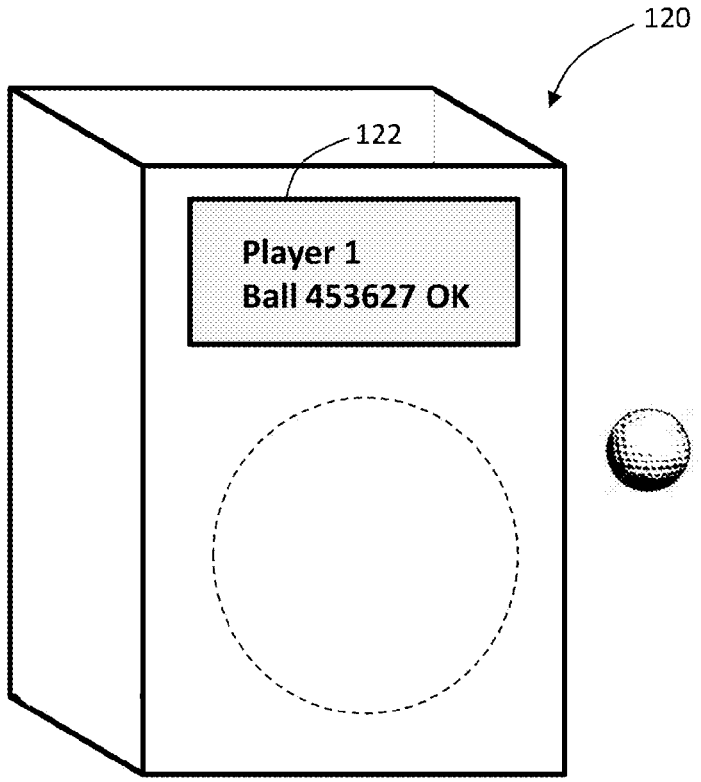

Referring to FIGS. 3A and 3B there is shown two illustrative tee ball validators 100 and 120, respectively. The tee ball validators 100 and 120 are configured to operate as RFID readers positioned in a vertical plane and are configured to read RFID golf balls along a vertical axis. A tee area (as described in FIG. 4 below) has a hitting surface on which the RFID golf ball is placed before it is hit by the golf club. The illustrative tee ball validator 100 or 120 is positioned near the tee area. The tee ball validator 100 or 120 validates the RFID golf ball before it is struck by the player and associates that RFID golf ball with the player.

Illustrative tee ball validator 100 includes an enclosure 102, an RFID transmit and receive antenna 104, multiple visual indicators, 106, 108, 110, and associated electronic components as described herein. The illustrative antenna (not shown) within the enclosure 102 is an antenna 104 that is designed to detect RFID tags. The RFID reader 100 is operatively coupled to a processor or controller (not shown) that provides the detection logic, which identifies the unique identifier signal embedded in the RFID golf ball 112. In operation the RFID reader or tee ball validator 100 then forwards the unique identification number to an application processor (not shown) associated typically with a server (not shown). The RFID reader 100 communicates with a local area network using an illustrative ethernet based system. The illustrative server runs an illustrative relational database management system that validates the player and the RFID golf ball. The tee ball validator 100 communicates with the illustrative server and receives instructions that control a player display that provides information to the player. The illustrative player display may include visual indicators 106, 108 and 110 that may be associated with colors red, orange and green. These visual indicators present information to the player about a particular game.

The server that runs the application program for validating the RFID golf ball and validating the player may be located in a centralized location so communications for a plurality of tee ball validators can be centrally managed and controlled.

Before striking an RFID golf ball, the player must register the RFID golf ball with the system. Registration of the RFID golf ball is performed by passing the RFID golf ball in front of the RFID antenna which reads at least one unique identifier associated with the RFID golf ball.

If the RFID reader is identified as a valid RFID golf ball that is within the database. The ball is then associated with the player in that position or golf bay and the indicators are changed to let the player know that the ball is registered and ready to be hit toward the target.

If the tee ball validator is configured in the manner of FIG. 3A, the communication with the player would be to activate an indicator specifying that the ball is registered and ready for play. As an example, one of the available indicators might be green, indicating that a valid ball has been detected and successfully registered to the player. The player would then drop the ball onto the hitting surface and hit it toward the target. If the ball does not register correctly at the tee ball validator, then the player must choose another ball before playing.

Other indicators may be activated to alert the player that a valid ball has been detected but that the identity of the player in that position is not known, or that some other error has been detected. In an alternative form of the tee ball validator, shown in FIG. 3B, the set of visual indicators is replaced by a visual display 122. This could be a small video screen imbedded in the device, a remotely positioned monitor, mobile computing device, or other communication medium.

Figure 4:
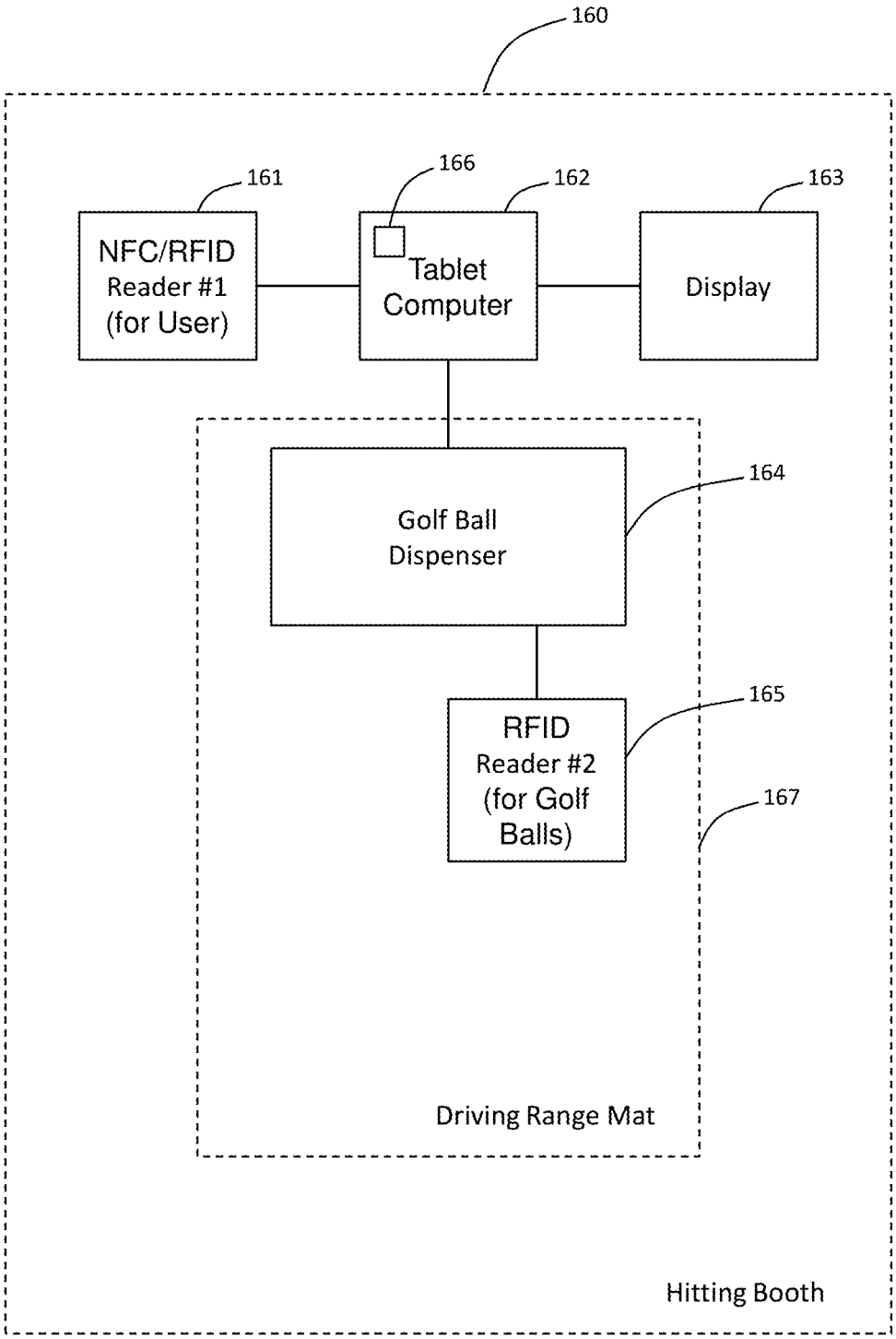
FIG. 4 shows system components in an illustrative golf driving range hitting booth.

Referring to FIG. 4 there is shown an illustrative system of components in an illustrative golf driving range hitting booth or golf driving bay. Note, the terms "driving range hitting booth" and "golf driving bay" are used interchangeably in the description presented herein. The illustrative hitting booth 160 includes a scanner 161, a client computer 162, a display 163, a golf dispenser 164 and an RFID reader 165. The illustrative scanner 161 is a Near Field Communications (NFC) reader or an RFID reader for a membership card with an RFID tag. The illustrative scanner reads an electronic device (not shown) that is associated with the particular player. The illustrative electronic device may be a wireless handset or RFID card associated with the particular player.

After the scanner 161 reads the player's electronic device, an identification (ID) number associated with the player's electronic device is activated in a centralized database (not shown), and the illustrative tablet computer 162 and display 163 present the player information. The illustrative client computer 162 is a tablet computer such as an iPad® manufactured by Apple Inc. Display 163 is much larger and presents the player information to other players in proximity of the hitting booth 160.

In operation, a player enters the golf driving range hitting booth 160. On an illustrative client computer 162, such as an iPad® tablet computer mounted to a support column (not shown) on one side of the booth, the player scans his or her electronic device, such as a Near Field Communications (NFC) device or a membership card with an RFID tag, with the scanner 161. The electronic device identifies the particular player. More players can join the game at the hitting booth or via a gaming server from different booths or site locations, thereby allowing for other players from other locations to play against one another.

After the player selects a game using tablet computer 162, an RFID golf ball is dispensed from golf ball dispenser 164. In the illustrative embodiment, a golf ball with an UHF omnidirectional RFID chip is dispensed on to a driving range mat by golf ball dispenser 164. A more detailed description of the RFID golf ball is provided below. When the golf ball dispenser 164 dispenses the RFID golf ball, the RFID reader 165 with an RFID near field read (NFR) antenna reads the RFID golf ball. The RFID reader 165 is communicatively coupled to a network having a server that receives the RFID golf ball information. More particularly, the unique ID from the RFID tag in the RFID golf ball is read and inserted into a database table that contains the logged-in user ID. After the golf ball rolls onto the driving range mat, the golf ball is hit by the player.

The illustrative client computer 162 includes a touch screen display that allows a player to interact with a game selection module 166. The game selection module 166 includes at least one game of skill, in which an award is provided when the RFID golf ball associated with the player ID is read by the target RFID reader that is associated with the capture area. By way of example and not of limitation, the award may be a predetermined number of points based on the distance and size of the capture area.

An alternative embodiment, the game selection modules 166 includes at least one game of chance, in which a game session for the game of chance is initiated when the RFID golf ball associated with the player ID is read by the target RFID reader, a random result for the game session is generated, and a paytable associates a prize with the random game session result. The awarded prize is then displayed to the player.

In another embodiment, the game selection module 166 includes a game that has both a first game of skill component and a second game of chance. The embodiment starts with the player, by way of example and not of limitation, hitting the ball in the target area and getting points, and a subsequent game of chance, i.e. spinning a wheel for additional points. In operation, a first award is initially provided when the RFID golf ball is received by the capture area. This first award is based on the player's skill in hitting the ball at the appropriate target. The player then has the opportunity to play a second game of chance. By way of example and not of limitation, the second game may be referred to as a bonus game, in which the bonus game is a game of chance, where the player gets to spin a wheel. The random prize corresponding to the spinning wheel is then awarded to the player. Alternative games of chance include reels in a slot machine, virtual scratcher, bingo card, lottery game or other such graphic representation of a game of chance.

In another game embodiment, after a predetermined number of misses by the player, e.g. after 20 balls have been hit but none landed in the target area, the game session for the game of chance is initiated. Therefore, the player can continue to play the game and win points, even if he or she lacks the skill necessary to hit the golf ball into the target.

Figure 5A:
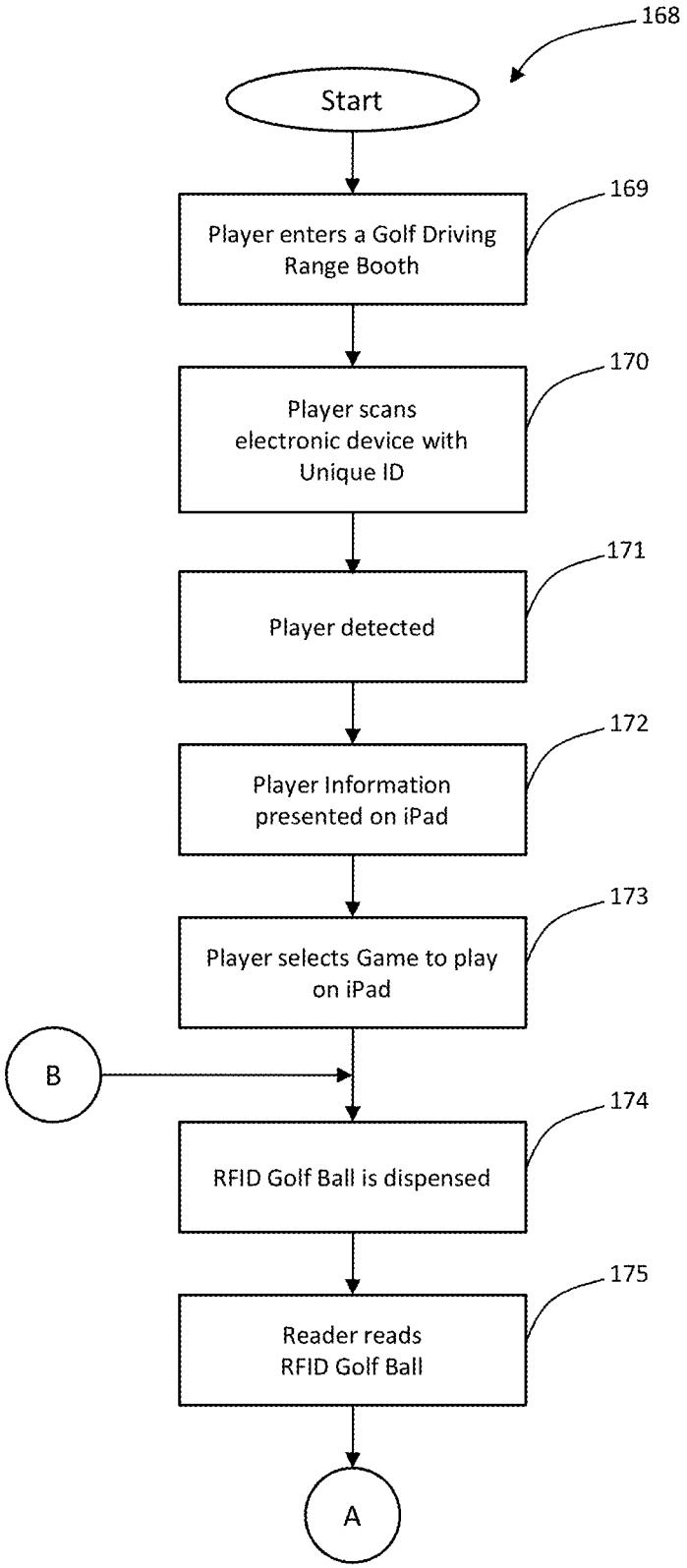
FIG. 5A shows a first portion of an illustrative method for operating an RFID golf ball range target system.

In FIG. 5A, there is shown a first portion of an illustrative method 168 for operating an RFID golf ball range target system. The method is initiated at block 169, when the player enters a golf driving range booth. At block 170, the player scans an electronic device with a unique ID and the player is detected at block 171. Player information is presented at block 172. The player then proceeds to select a game to play on a tablet computer as described in block 173. At block 174, the RFID golf ball is dispensed and the reader reads the RFID golf ball at block 175.

Figure 5B:
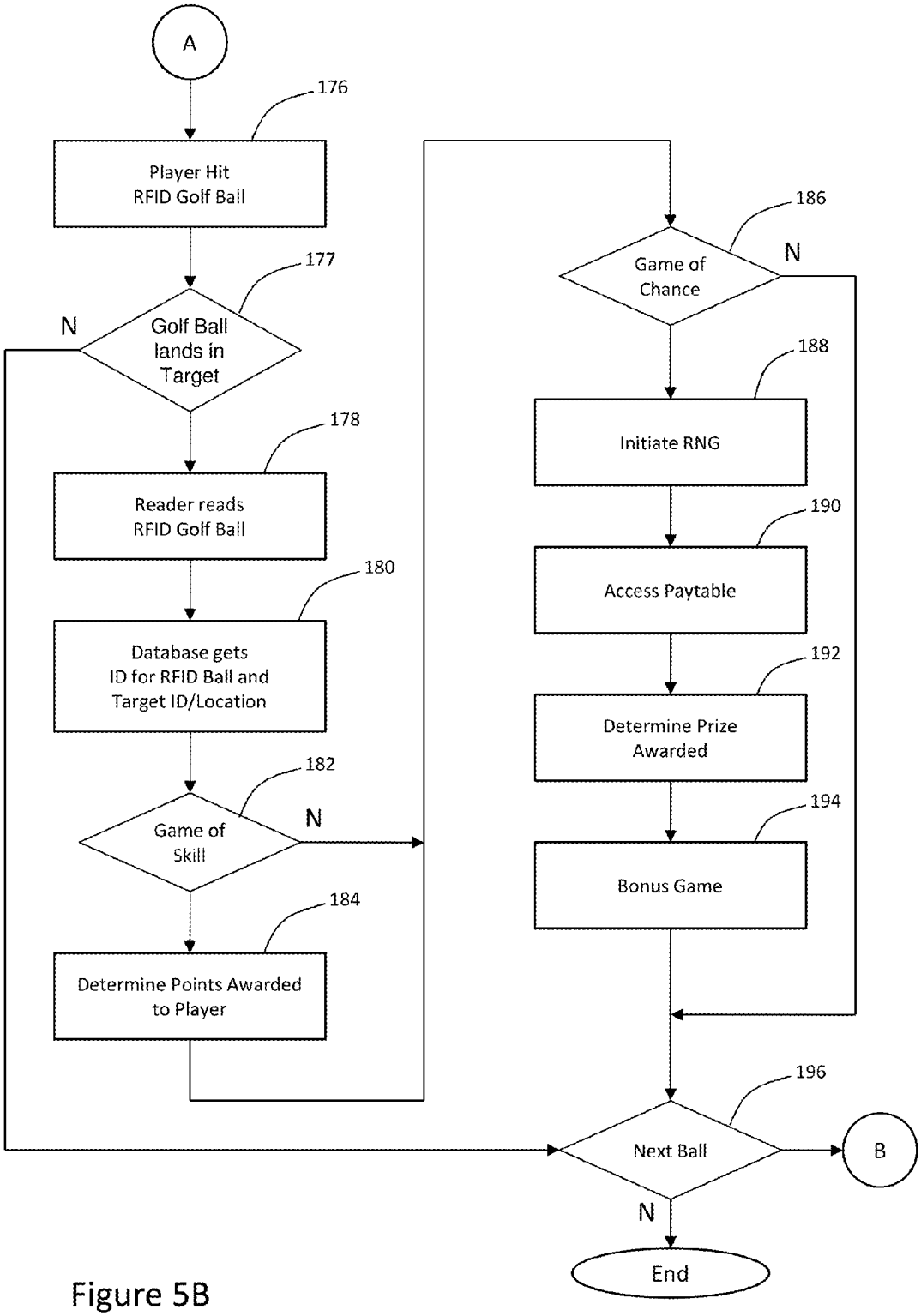
FIG. 5B shows a second portion of the illustrative method for operating the RFID golf ball range target system.

FIG. 5B shows a continuation of the illustrative method 168 for operating the RFID golf ball range target system. At block 176, the player hits the RFID golf ball. The method then proceeds to decision diamond 177, where a determination is made whether the golf ball hit the target area. If the golf ball lands in a target, the RFID golf ball is channeled into another RFID NFR antenna and RFID reader computer that is connected to the network as described in further detail below.

If the RFID ball does not land in the target area, then the method proceeds to decision diamond 196, where a new golf ball may be dispensed and zero (0) points are awarded for the missing the target area.

At block 178, the target RFID reader(s) read the RFID golf ball. The golf ball's unique tag ID is read from the golf ball and the location of the target's ID is sent to the database.

At block 180, the database gets the ID for the RFID ball and Target ID/location. The golf ball's unique ID is searched for and if the ball ID is found, it is allocated to a current logged-in player, a database point list algorithm determines the points for that target, and an action is triggered.

At decision diamond 182, a determination is made whether a game of skill has been initiated. If a game of skill has been initiated, an amount of points is awarded to a player at block 184. In the illustrative embodiment, points associated with a particular target, player ID and game session are associated with the appropriate database fields. If the game of skill has not been initiated, the method proceeds to decision diamond 186.

At decision diamond 186, a determination is made whether a game of chance has been initiated. In the first game of chance embodiment, when the RFID golf ball lands in a target, a slot machine reel spins on the tablet client computer 162 and display 163 at the player's hitting booth 160. The awarded points are then calculated in the database for that player and posted to the player's displays, on a web site, and various displays throughout the facility (like a leader board).

In another game of chance embodiment, an illustrative random number generator is initiated is initiated at block 188. At block 190, the appropriate paytable is accessed for the particular game of chance. The prize that is awarded according to the paytable is determined at block 192. At block 194, an illustrative bonus game is initiated.

At decision diamond 196, a determination is made whether to play the next ball. The database of points for the active player is then displayed in a game format on the tablet and display at the hitting booth, on a web site and various displays throughout the facility (like a leader board).

Figure 6:
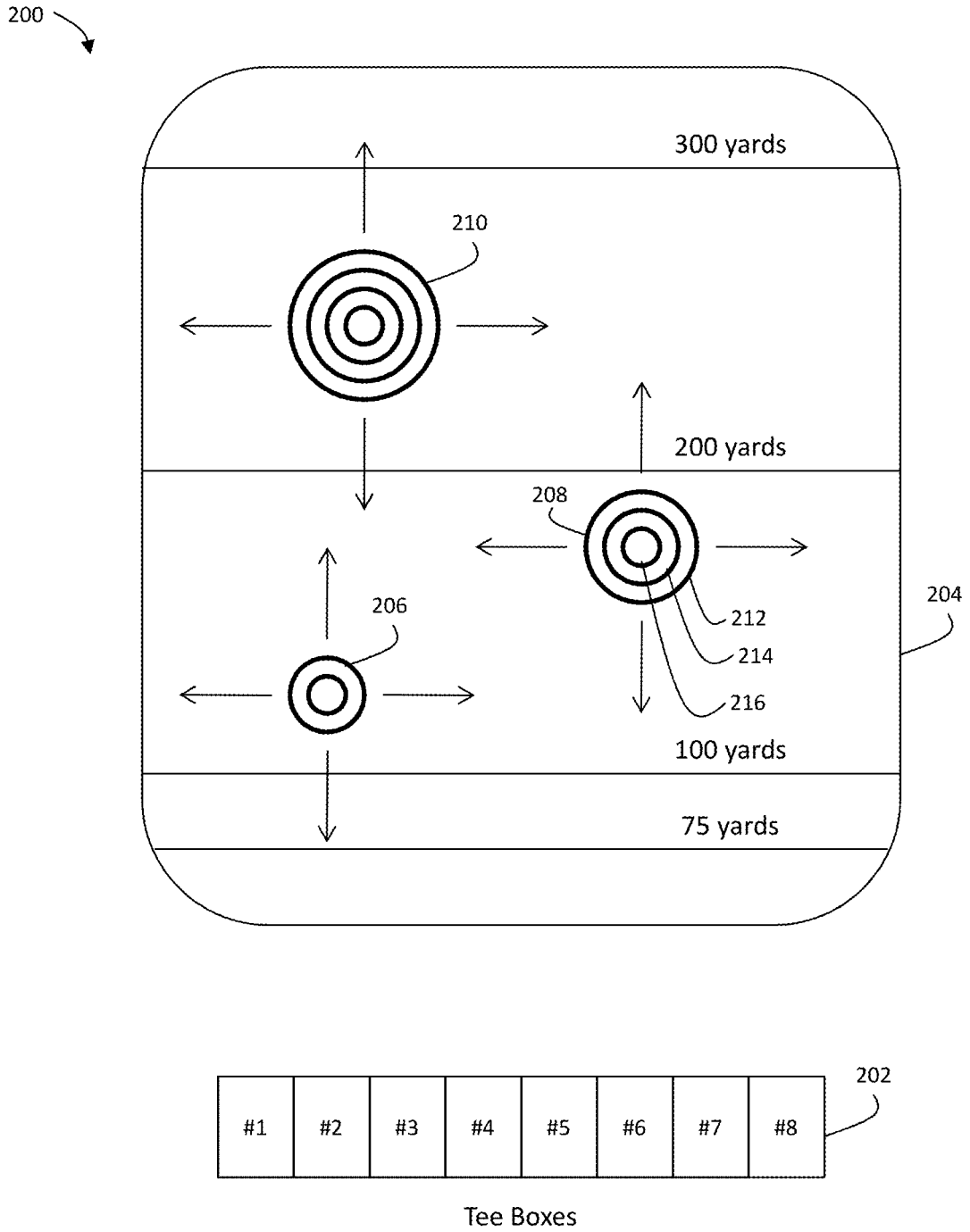
FIG. 6 shows an illustrative driving range having movable targets.

Referring to FIG. 6, an illustrative driving range 200 having movable targets is shown. Tee area 202 has tee boxes numbered #1 through #8. A player enters one of the tee boxes and hits a golf ball from the tee box onto the target area 204, with the objective of hitting a ball into one of the movable targets. Movable targets 206, 208, and 210 are shown. The arrows shown adjacent to the targets indicate that the targets are movable. Any of the targets may be relocated to any position on the target area 204.

The movable targets include at least one enclosed boundary capture component having a top boundary edge, a bottom boundary edge, and a tapering surface material that joins the top boundary edge to the bottom boundary edge. By way of example and not of limitation, the tapering surface material may be composed of a plastic UV resistant material. The shape of the enclosed boundary components can include curved sectors or segments that are connected to one another resulting in a variety of different sizes and shapes. Thus, the shape of the enclosed boundary capture component is determined by engineering and design constraints.

If the player is aiming for target 208, the player will be awarded a point value for landing a ball in exterior funnel 212. A higher point value is awarded for landing the ball in inner funnel 214. The highest point value for target 208 is awarded when the player is able to land a ball in innermost funnel 216. In one embodiment, the target is a fixed target and includes RFID antennas under turf such as Astroturf. The RFID antennas are then associated with a particular RFID reader.

Referring to FIGS. 7A-7D, there is shown a planar molded impression in a molded compressible core 220 that receives an RFID tag. The RFID tag 222 includes an RFID integrated circuit with a memory, as described above, which includes at least one unique identification number. The RFID tag 222 also includes an RFID antenna electrically coupled to the RFID integrated circuit.

Figure 7A:
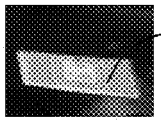
FIGS. 7A-7D show a planar molded impression in a compressible core that receives an RFID tag composed on an inlay material.
Figure 7B:
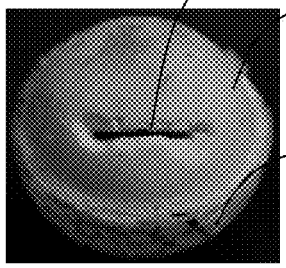
Figure 7C:
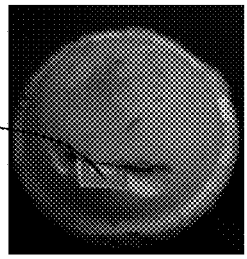
Figure 7D:
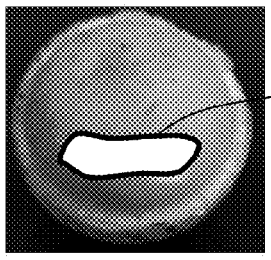

In FIG. 7B, a compressible core 224 is shown. Additionally, a portion of molded shell 226 for the RFID golf ball is also shown. A molded impression 228 is configured to receive the RFID tag inlay 222, as shown in FIGS. 7C and 7D. The molded flexible core has a center and a spherical surface. Additionally, the molded impression receives the inlay material with the antenna and RFID integrated circuit. In this embodiment, the molded impression 228 is a planar slot disposed in the center of the molded flexible core. More generally, the planar slot receives a planar inlay material, e.g. RFID tag inlay 222, which includes an antenna electrically coupled to the RFID integrated circuit. In FIG. 7D, there is also shown a fill material 230 that is used to fill any gaps in the molded impression that receives the RFID tag inlay 232.

One of the most important elements of the RFID tag inlay is the selection of the adhesive. In one embodiment, the antenna may be electrically coupled to the RFID integrated circuit with an anisotropic conductive adhesive. Additionally, the antenna may be electrically coupled to the RFID integrated circuit with a non-conductive adhesive.

In operation the RFID golf ball 112 is read by an RFID ball reading system that includes an RFID reader as described in FIGS. 2-5 and FIG. 13.

Figure 7E:
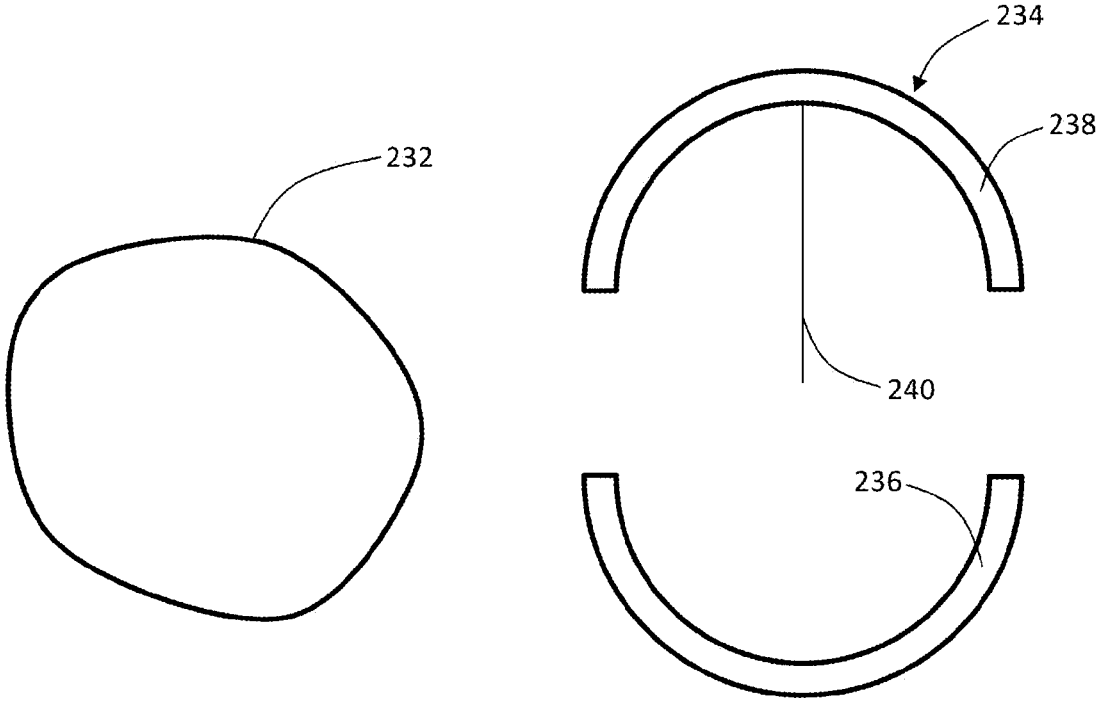
FIG. 7E shows the mold used to generate the planar molded impression.

A method for embedding an RFID tag begins with an extruded slug 232 being placed in a core mold tray that includes a mold 234, as shown in FIG. 7E. The mold 234 includes a lower mold portion 236 and an upper mold portion 238. The upper mold portion 238 further includes a planar projection 240. The slug is a compressible compound that is heated to generate the compressible core of the golf ball.

By way of example and not of limitation, the planar projection 240 leaves a molded impression that has an Illustrative size of 30 mm deep×9 mm wide×0.5 mm high. In operation, the planar projection 240 may be a heated metallic projection that is blade shaped. After the core has cooled, the RFID tag inlay is inserted into the molded impression.

After the compressible compound in the mold is heated and the mold is removed, the planar projection 240 leaves the planar molded impression 228. The RFID tag inlay 222 is then placed in the molded impression. A fill material is then applied that fills the molded impression occupied by the RFID tag inlay 222. The molded flexible core 224 is then encapsulated with a molded shell, which is the cover of the golf ball.

After the RFID chip is placed in the slot, there may be a need for a filler material to be included. The filler material may be rubber like. Additionally, the material such as use Teslin (which is 60% air) may be used as filler material.

Various engineering constraints that affect the design of the RFID golf ball include selection of the integrated circuit or "chip" characteristics such as memory, processor, performance, price, and how the chip and the antenna are electrically coupled, including RFID tag inlay or packaged die with soldered leads as described below.

In the illustrative embodiment, the RFID tag inlay includes an integrated circuit or "chip" or "die" and an antenna. The antenna may be composed of aluminum, copper, or silver and is bonded to a polyethylene terephthalate (PET) layer that is delivered to the label maker "dry" (without adhesive) or "wet" (attached to a pressure sensitive liner). The inlay is adhered to the back side of the label and printed and encoded in an RFID printer.

Adhesive materials can be used to attach dies onto antenna to build the inlays. In one embodiment, an interconnect adhesive is used to attach a small bare die directly to an antenna. In another embodiment, an interconnect adhesive is first used to build a much larger packaged die, which is then adhered onto an antenna. Both methods of assembly have been successfully employed to make RFID tags.

Generally, the RFID tag may also include a "carrier" or "substrate" on which the chip and antenna are disposed. The carrier or substrate may include an adhesive. For example, anisotropic conductive adhesives can be used to attach bare dies to antenna substrates. Anisotropic conduct in only one direction and is filled with small amounts of electrically conductive particles. Nonconductive adhesives may also be used to attach small dies on to an antenna, in which die bumps are directly connected to the antenna pads using mechanical means. The nonconductive adhesive provides structural support and increases tag reliability.

Figure 8A:
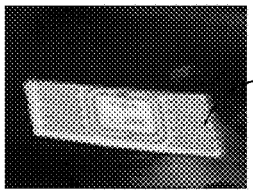
FIGS. 8A-8B show a curved molded impression in a compressible core that receives an RFID inlay material.
Figure 8B:
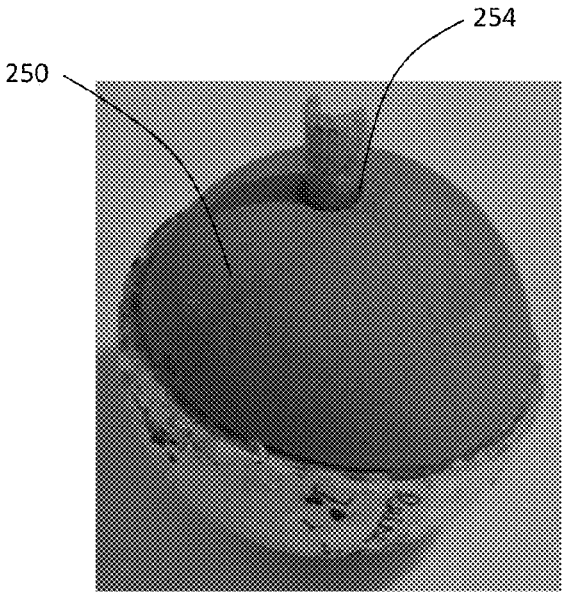

Referring to FIG. 8A-8B, there is shown a curved molded impression in a compressible core 250 that receives an RFID inlay tag 252. The circular molded impression 254 is disposed in the center of the molded flexible core 250. The curved molded impression 254 receives the curved RFID inlay tag 252 that includes a curved antenna electrically coupled to the RFID integrated circuit.

The molded impression 254 may also be a cylindrical slot disposed in the center of the molded flexible core. The cylindrical slot 254 receives a curved inlay material that includes a curved antenna electrically coupled to the RFID integrated circuit. A fill material (not shown) fills the cylindrical slot 254. Generally, the fill material has material properties that are similar to the compressible core material.

Figure 8C:
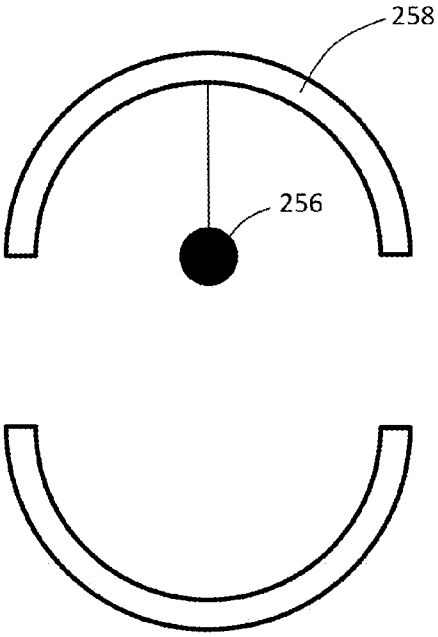
FIGS. 8C and 8D show the mold used to generate the curved molded impression.

Referring to FIG. 8C, there is shown a cylindrical projection 256 in a top mold portion 258. The cylindrical projection 256 leaves a cylindrical mold impression 254 that is filled with an RFID inlay tag 252 and the appropriate fill material.

Figure 8D:
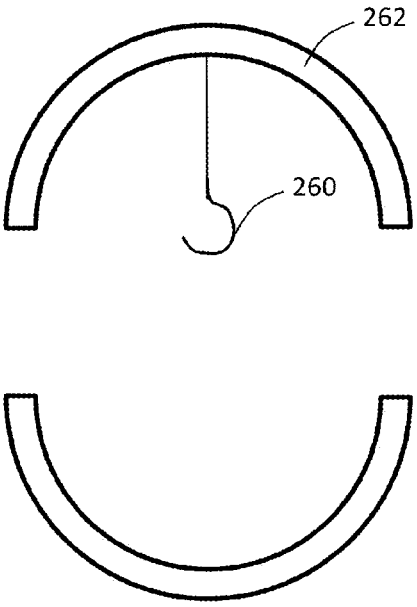

In FIG. 8D, there is shown a curved projection 260 that is associated with a top mold portion 262. The curved projection 260 generates a curved mold impression 254 that is configured to receive the RFID inlay tag 252. Additionally, a fill material may be used to occupy any remaining space in the curved mold impression 254.

Figure 9A:
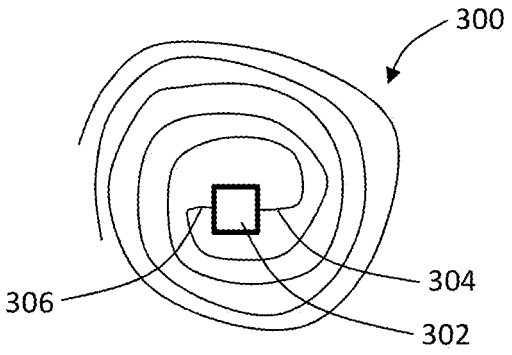
FIGS. 9A-9D show an RFID tag sandwiched between a first split core section and a second split core section.
Figure 9B:
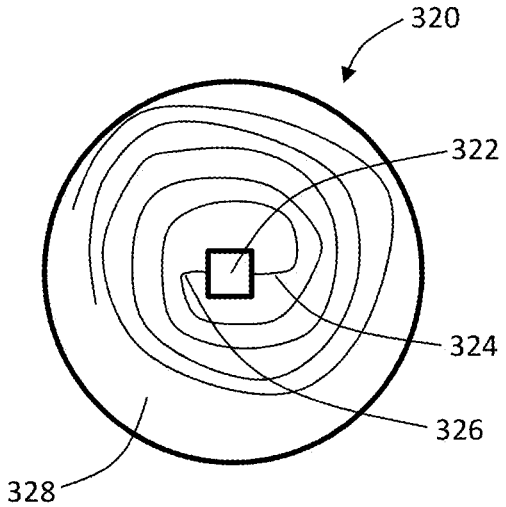
Figure 9C:
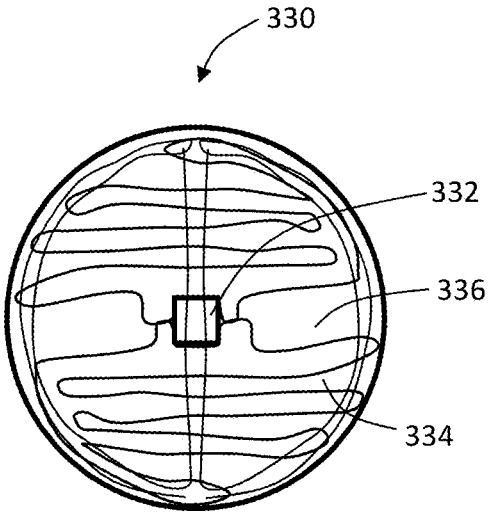
Figure 9D:
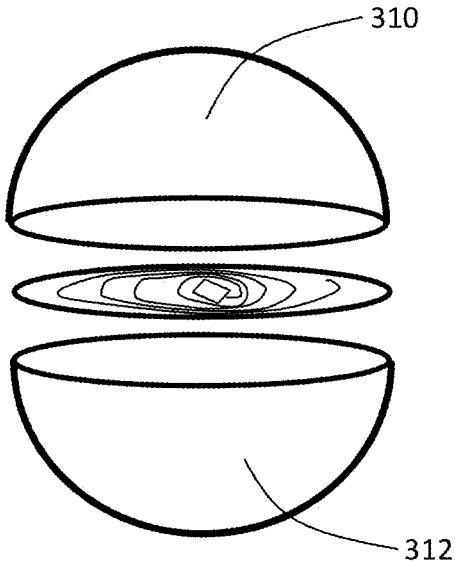

Referring to FIGS. 9A-9C, there is shown various RFID tags that are sandwiched between a split compressible core as shown in FIG. 9D. In FIG. 9A there is shown an RFID tag 300 that includes an RFID integrated circuit 302, a first conductive wire 304 and a second conductive wire 306. There is no substrate or carrier in FIG. 9A. The conductive wires 302 and 304 may be a single conductive wire or may include multiple stranded wires. In FIG. 9A, there is no inlay and the wires are shown in a top view, so the combination of the RF integrated circuit and conductive wire(s) is along a plane that can be disposed between a top hemisphere 310 and bottom hemisphere 312, presented in FIG. 9D.

Referring now to FIG. 9B, there is shown an RFID tag 320 that includes an RFID integrated circuit 322, a first conductive wire 324, a second conductive wire 326, and a carrier or substrate 328. The conductive wires 324 and 326 may be a single conductive wire or may include multiple stranded wires. In FIG. 9B, there is a carrier that is coupled to the conductive wires 324 and 326 as a dry inlay (no adhesive) or as a wet inlay (with adhesive). FIG. 9B presents a top view so the combination of the RF integrated circuit and conductive wire(s) are along a plane that can be disposed between the top hemisphere 310 and bottom hemisphere 312 presented in FIG. 9D.

Referring to FIG. 9C, there is shown an RFID tag inlay 330 that includes an RFID integrated circuit 332, a printed antenna 334, and a carrier 336 that are coupled together as a dry inlay or as wet inlay. By way of example and not of limitation, the carrier material may be composed of a very light substrate such as a low-density or high-density polyethylene compound. FIG. 9C presents a top view of the RFID tag inlay that is placed between the top hemisphere 310 and bottom hemisphere 312 presented in FIG. 9D.

The RFID tag sandwiched between the top hemisphere 310 and the bottom hemisphere 312 is then placed in a mold (not shown) that includes a lower tray (not shown) and upper tray (not shown). The mold is then heated and the top hemisphere 310 and bottom hemisphere 312 are melted so that the appropriate RFID tag inlay (300, 320 or 330) is encased within a newly pressed spherical compressible core that is then encased or encapsulated by a dimpled molded covering or shell.

In each of the split core embodiments, after the RFID chip has been sandwiched between hemispheres, the combination of half cores, RFID chip, and antenna are then placed in the appropriate mold and reheated. The reheat temperature is dependent on material properties of the core, the RFID chip, the antenna, and the carrier. For illustrative purposes, reheat is performed at about 130° C.-204° C. and depends on the amount of applied pressure. In a narrower embodiment, the reheat temperature of about 204° C. (400 F) is applied for about 15-25 minutes.

Alternatively, a slug as shown in FIG. 7E above may be split into two sections and the carrier material having the RFID chip and antenna disposed thereon can be sandwiched between the two slug sections. The split slug with the sandwiched RFID tag may then be placed in a mold that is heated to form a compressible core with an embedded RFID tag.

During manufacturing, a filler material is applied to fill any gaps in the molded impression 402. The molded shell 406 is then applied. The resulting RFID golf ball 420 has the benefit of having the chip in the center and dampening the impact of being hit by a golf club, and the curved antenna does not possess any sharp turns thereby minimizing breaking the antenna.

Referring to FIGS. 10A-10E, there is shown a molded impression that receives an encapsulated RFID tag at the center of the compressible core. More particularly, in FIG. 10A there shown a side view of a molded impression 402 that extends to the center of the compressible core 404. A molded shell 406 further encapsulates the compressible core 404. The illustrative molded impression 402 includes a round hole 408 that extends to the center of the core 404. Additionally, the molded impression includes side wings 410*a* and 410*b* that are adjacent to the round hole 408.

Figure 10A:
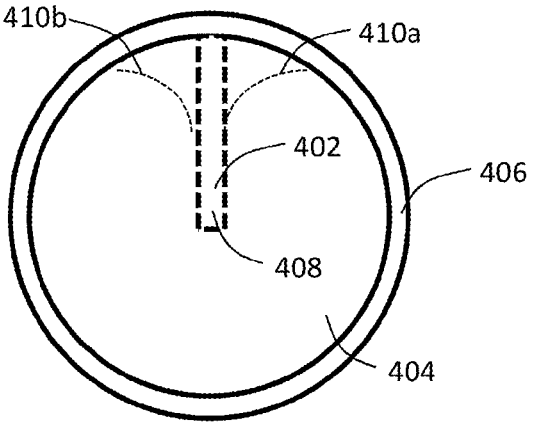
FIGS. 10A-10E show a molded impression that receives an encapsulated RFID tag with conductive wires at the center of the core.
Figure 10B:
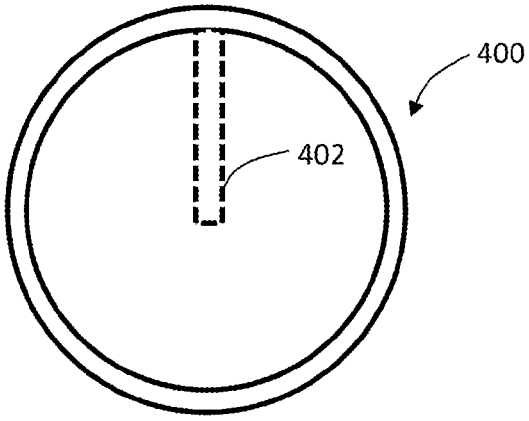

In FIG. 10B, another side view is presented that is 90° from the FIG. 10A. In this second side view, the side wings 410*a* and 410*b* and the round hole 408 associated with molded impression 402 are in the same plane.

Figure 10C:
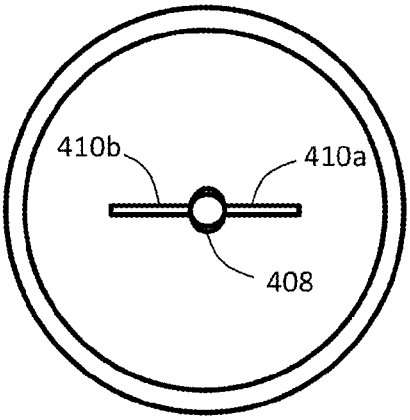

In FIG. 10C, a top view is presented of the molded impression 402 that includes the rounded hole 408 and side wings 410*a* and 410*b*.

Figure 10D:
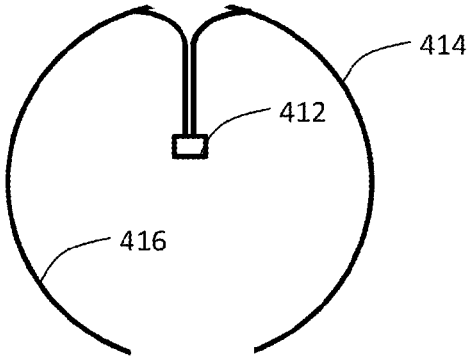

FIG. 10D presents an encapsulated RFID integrated circuit 412 that is electrically coupled to antenna 414 and 416.

Figure 10E:
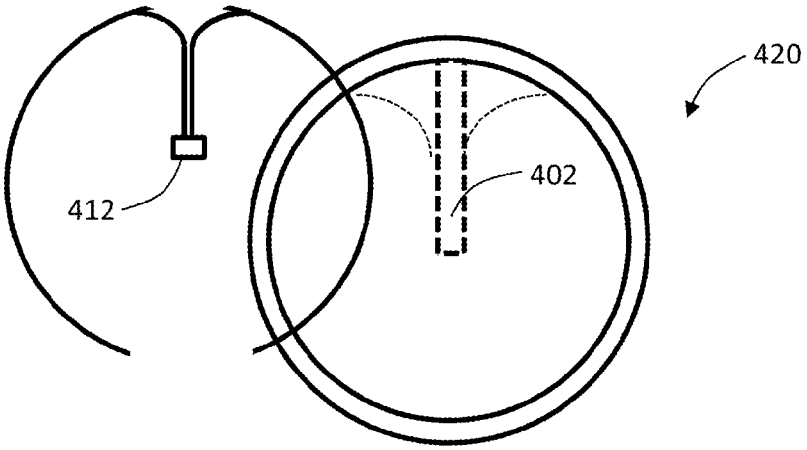

The RFID chip 412 fits into the center of the molded impression 402 as shown in FIG. 10E. The antennas 414 and 416 interface the side wings 410*a* and 410*b*, respectively. An adhesive is applied to the RFID chip 412 so the chip is fixedly coupled to the center of the compressible core. The antenna 414 and 416 may be single conductive wire or a plurality of stranded wires that are braided.

During manufacturing, a filler material is applied to fill any gaps in the molded impression 402. The molded shell 406 is then applied. The resulting RFID golf ball 420 has the benefit of having the chip in the center and dampening the impact of being hit by a golf club, and the curved antenna does not possess any sharp turns thereby minimizing breaking the antenna.

Figure 11A:
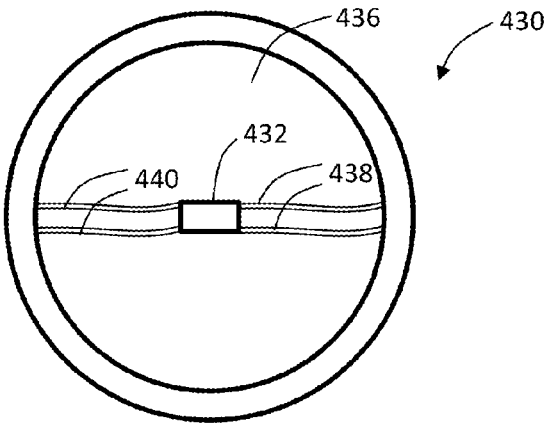
FIGS. 11A-11F show different antenna that are electrically coupled to an RFID integrated circuit disposed on a molded impression at the surface of the compressible core.

Referring to FIGS. 11A-11F, there is shown another embodiment with an RFID integrated circuit disposed on the surface of a compressible core. FIG. 11A presents a top view of a ruggedized RFID integrated circuit 432 located within a molded impression on the surface of compressible core 436. The RFID integrated circuit 432 includes contactless pads (not shown) or "leads" that are soldered to conductive wires 438 on a first side, and conductive wires 440 on an opposite side that operate as antennas. Additionally, a non-conductive material such as an epoxy can be used to further join or better secure the soldered side of the RFID package to the antennas 438 and 440.

Figure 11B:
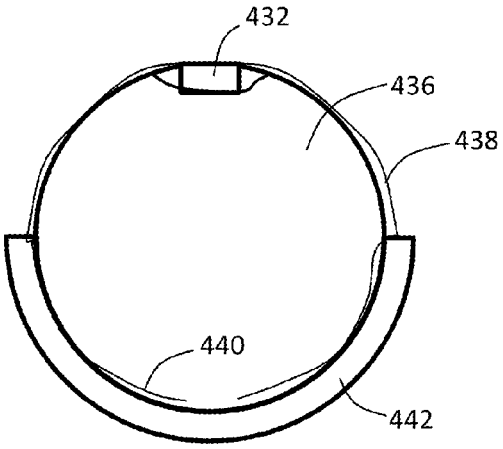

Referring to FIG. 11B, there is shown a side view of the RFID integrated circuit 432 on the surface of the compressible core 436. A portion of an exterior molded shell 442 is also visible. The conductive wires 438 and 440 are shown to extend approximately half way along the surface of the compressible core 436.

By way of example and not of limitation, the RFID integrated circuit 432 is a Monzan RFID chip or Monza Dura, which is packaged in a ruggedized tag packaged format with leads, as shown above in FIG. 1B. The Monza Dura is an Impinj chip that is a fully EPC global-compliant, high-performance, Monza-powered tag with printed circuit board (PCB) applications and enabled ruggedized tag design.

Figure 11C:
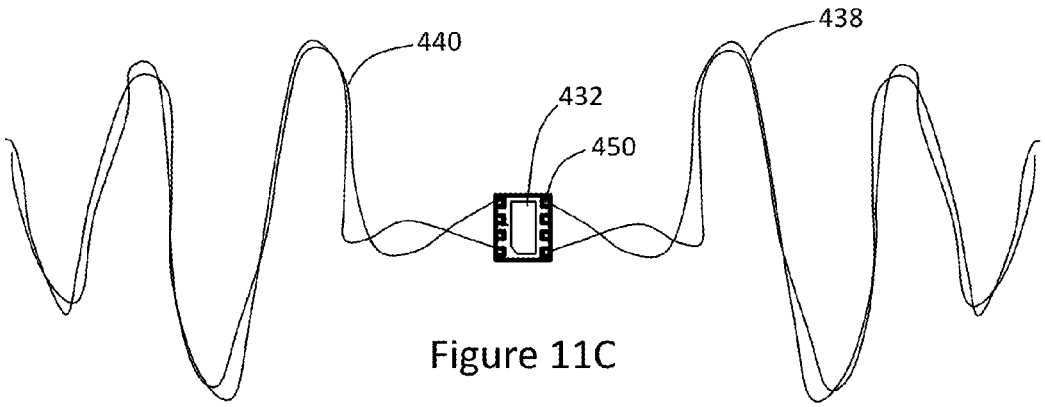
Figure 11D:
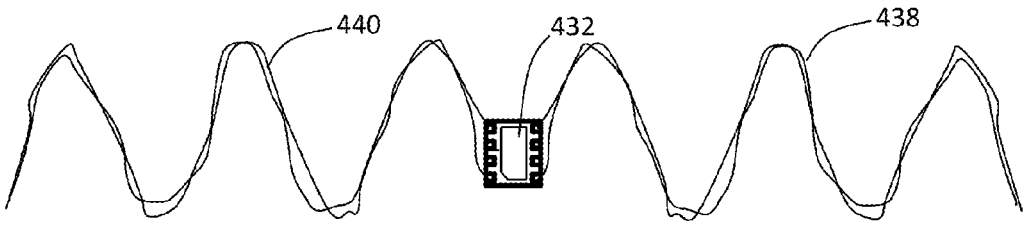
Figure 11E:
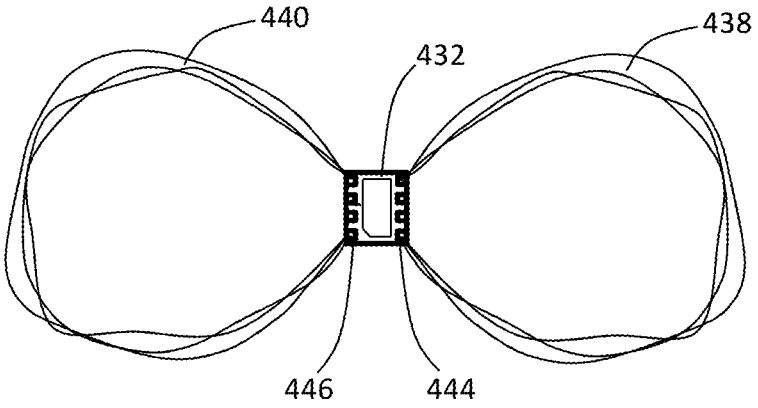
Figure 11F:
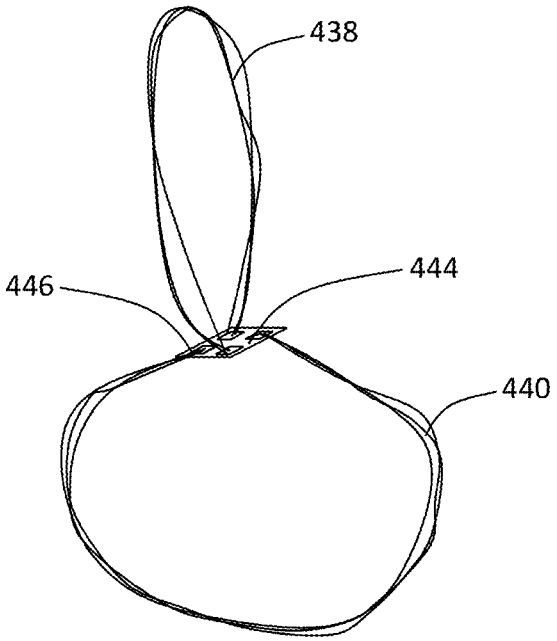

In the illustrative embodiment, the antennas 438 and 440 are soldered to RFID package leads in a wire pattern shown in FIGS. 11C and 11D, and a loop pattern shown in FIGS. 11E and 11F. The conductive wires or antennas may be a single wire or a plurality of stranded wires. In the illustrative embodiment, the plurality of stranded wires is a braided wire that may be used to lessen the chance for a fatigue failure of a single-wire antenna.

In FIG. 11C, the illustrative RFID chip 432 includes a plurality of contacts pads such as contact 450. Contact 450 has a relatively small footprint of approximately 0.3 mm by 0.3 mm. This relatively small footprint has to be electrically coupled to antennas 438 and 440. The antennas 438 and 440 are composed of conductive wire. By way of example and not of limitation, the conductive wire is a fine copper wire having a diameter of approximately 0.03 mm. The illustrative braided wire can be more generally referred to as stranded wire. Stranded wire is more flexible than solid wire of the same cross-sectional area. Additionally, stranded wire provides higher resistance to metal fatigue.

The illustrative RFID chip 432 is encased in dual flat no (DFN) lead style of packaging that has no pins or wires, but uses contact pads instead. The illustrative material encasing the RFID chip 432 is a rigid material such as a polyamide epoxy material with the contacts 450 exposed.

The antennas and chips are matched so as to optimally function at appropriate frequencies and generally only at the tuned frequency. The most common frequencies are low frequency (LF), high frequency (HF) and ultra high frequency (UHF).

In FIG. 11C the antennas 438 and 440 are configured as a dampened waveform, in which the amplitude of the sinusoidal waves decrease as a function of the distance from the RFID chip 432. In FIG. 11D, the antennas 438 and 440 are configured as a waveform, in which the amplitude of the sinusoidal waveforms remains constant as a function of the distance from the RFID chip 432. In both embodiments shown in FIGS. 11C and 11D, the conductive wires or antennas 438 and 440 may be single conductive wire or multiple stranded wires that may be braided.

In FIGS. 11E and 11F two different "figure-eight" embodiments are shown. More particularly, in FIG. 11E there is shown a planar embodiment where the ends of the conductive wires 438 terminate at on the same side 444 of the RFID chip 432. The conductive wires 440 also terminate on the same side 446.

In FIG. 11F, a first end of the conductive wire 438 is electrically coupled to one of the contact pads on side 444 and the second end of conductive wire 438 is coupled one of the contacts pads on the opposite side 446. Additionally, the ends of conductive wire 440 also terminate on side 444 and 446. The resulting figure-eight is not planar, and although with the appropriate molded impression the RFID chip may reside on the surface of the compressible core 436, this figure-eight embodiment may also be located in the center of the compressible core 436.

Figure 12A:
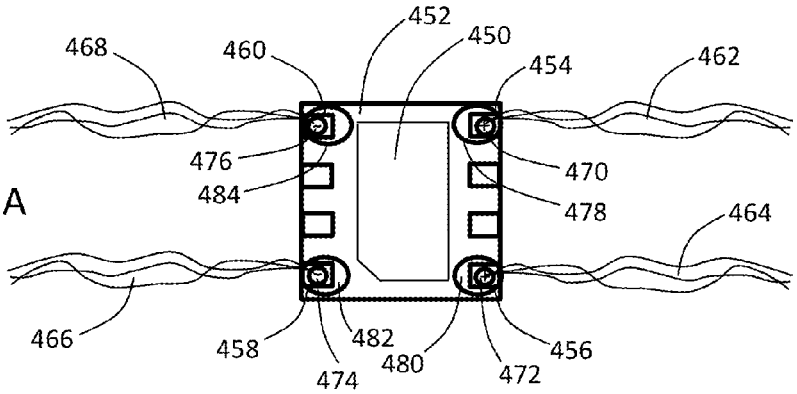
FIGS. 12A-12D show a thicker wire disposed between the conductive antenna wires and the encapsulated RFID integrated circuit.

Referring to FIG. 12A-12D there is shown an exploded view of an encapsulated RFID chip joined or fixedly coupled to at least one conductive wire. In FIG. 12A, the illustrative RFID chip 450 is shown to be packaged in a secondary protective package 452 or encapsulation material that is then connected to an antenna as described herein.

Alternatively, the RFID chip 450 may be mounted on a circuit board that is then communicatively coupled to an antenna (not shown). For example, RFID chip 450 may be mounted on a circuit board and have enhanced mechanical, electrical and thermal performance.

The selection of the encapsulation material may be dependent on the amount of vibration that is necessary to dampen the impact the golf club hitting the golf ball. By way of example and not of limitation, a material with a high dampening capacity may be silicon or include a silicon-based material. Thus, the encapsulation material may be silicon based and flexible. Alternatively, the encapsulation material may be more rigid, i.e. have a low dampening capacity, and for illustrative purposes is a polyamide epoxy.

After the RFID chip 450 is placed in the secondary protective package 452, the chip 450 is connected to an antenna. In FIG. 12A there is shown an exploded view of a plurality of stranded wires joined to the contact pads 454, 456, 458 and 460. For illustrative purposes, the remaining contact pads are not operable and are not electrically coupled to the RFID chip 450.

The contact pads 454, 456, 458 and 460 are each fixedly coupled to antennas 462, 464, 466 and 468, respectively, with a solder, i.e. conductive material. The solder material 470, 472, 474 and 476 joins the conductive wire or wires to the contact pads 454, 456, 458 and 460, respectively. The illustrative solder material may be about 96% Sn and about 4% Pb. Alternatively, the solder may include silver at about 7%. By way of example, the tensile stress on the on the solder joint may be approximately 15 psi.

Additionally, the solder may be combined with a non-conductive material such as an epoxy resin that can further absorb the impact of the golf club striking the golf ball. By way of example and not of limitation, the epoxy resin dots 478, 480, 482 and 484 cover the each of the contacts that have been soldered to the conductive wires.

The illustrative antennas 462, 464, 466 and 468 are composed of one or more copper wires. The plurality of conductive wires is also referred to as stranded wires. In the illustrative embodiment, the stranded wires are intertwined or braided.

Figure 12B:
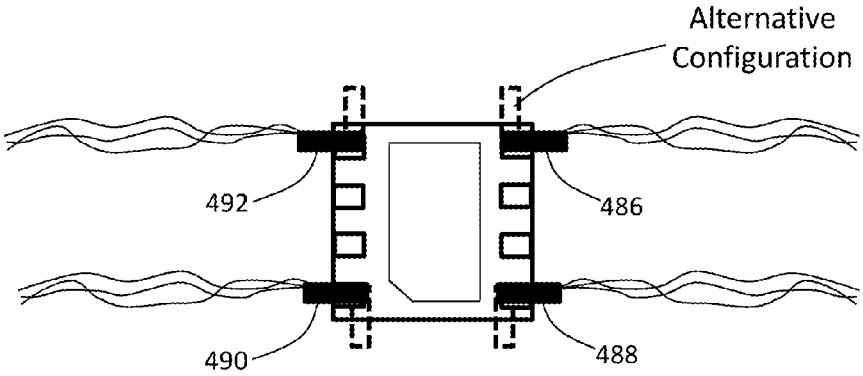
Figure 12C:
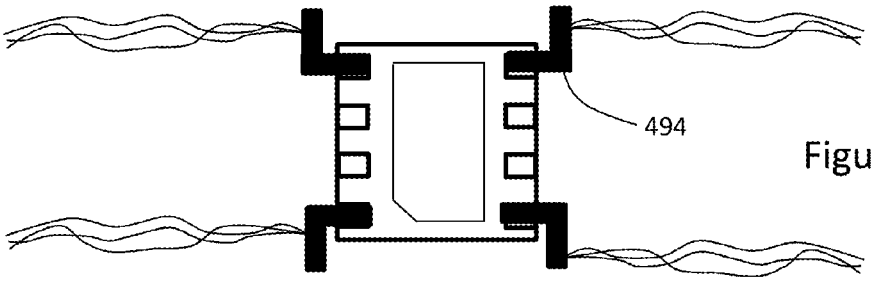
Figure 12D:
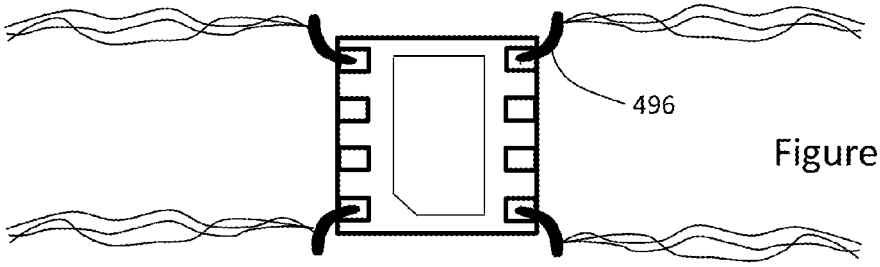

Referring to FIG. 12B, there is shown an exploded view of the encapsulated RFID chip 450, in which the contacts 454, 456, 458 and 460 are first electrically coupled to thicker wires 486, 488, 490 and 492 that interfaces with the contact pads. The thicker wires 486, 488, 490 and 492 are shown in two configurations. In each configuration, the thicker wires 486, 488, 490 and 492 increase the surface area of the contact pads, thereby simplifying the welding process and providing greater surface area for a non-conductive adhesive. In FIG. 12C, a stamped thicker wire 494 is shown having an about 90° angle. And in FIG. 12D, the thicker wire 496 is curved. After the thicker wires shown in FIGS. 12B-12D are joined to the contact pads 454, 456, 458 and 460, the conductive wires 462, 464, 466, and 468 are then fixedly coupled, i.e. joined, to the thicker wires.

An alternative to the conductive wires described above includes the use of conductive ink instead of conductive wires. The conductive ink can be printed directly on compressible ball or on to a carrier medium that is then joined to the compressible ball. The conductive ink may be composed of materials such as graphene, silver flakes, nanoparticles, and other such materials. By way of example and not of limitation, silver flake ink can be purchased from DuPont and requires a binder to bind the silver flakes.

In each of the embodiments described above, the tensile stress, tensile strain, and elasticity also affect the RFID integrated circuit, antenna, and means for joining the RFID integrated circuit to the antenna, e.g. a solder joint. Thus, depending on the material properties of the encapsulating material for the RFID chip, the material properties of the solder joint, e.g. stress on the solder, must also be considered. Additionally, the solder may also be combined with other materials such as an epoxy resin. The combination of materials affects the stress and strain at each solder joint, and the elastic modules corresponding to the solder joint. Thus, the engineering design is dependent on the material properties of the material encapsulating the RFID chip, the contacts on the RFID chip, the antenna wire, and solder joint that fixedly couples the antenna wire to the RFID chip contacts.

Referring now to FIG. 13, an illustrative system diagram 500 for the golf range target system is shown. In the illustrative embodiment, the player obtains a set of RFID golf balls dispensed by a golf ball dispenser such as that shown at 100 or 120 in FIG. 3. An issuing area RFID reader 502 may be a component of the golf ball dispenser, or may be located elsewhere at the driving range. The RFID golf balls are placed in or dispensed to an indicated designated area proximate to the issuing area RFID reader. Each RFID golf ball has a unique identification stored on the RFID transponder embedded within the ball. The issuing area RFID reader reads the unique identification from each of the plurality of balls. The issuing area RFID reader is communicatively coupled to an issuing area network communications module 514. The network communications module 514 is a transmitter which sends a signal to another device on a network. The network may be, for example, a local area network or wide area network. The identification of each RFID golf ball in the player's set of RFID golf balls, as detected by the issuing area RFID reader 502, is sent to server 504 via issuing area first network communications module 514. The server creates an entry in database 506 associating the identifications of the plurality of RFID golf balls with a unique identification associated with the player. The server 504 and database 506 may be located on site at the driving range. In some embodiments, the server or database or both the server and the database are located off site and receive communications from the RFID readers over, for example, a LAN, WAN, or the Internet. The server 504 and database 506 may be located in the same physical computer. Alternatively, an on-site server may be configured to communicate with an off-site server and database. Multiple databases may be used in conjunction with the one or more servers located on-site, off-site, or both. A multiple-site driving range establishment may use multiple servers to allow information to be collected from and distributed to the multiple sites.

The database may be configured to store additional information associated with a player including, but not limited to, a record of the player's play history at the driving range, transactional information, and account information. The player ID and other information associated with the player may be stored on a card having a magnetic stripe or other readable media. Alternatively, the player may be issued a PIN number or username and password combination associated with the player ID. In some embodiments, a temporary player account is created for short term use of the driving range. The player may receive a paper voucher indicating a temporary player ID in human-readable and/or barcode form. A paperless system for issuing a temporary player ID may involve communicating the player ID to the player visually or audibly, or associating a particular tee box with the player's set of RFID golf balls.

At the tee area, the player removes a ball from the set of RFID golf balls and places it on a tee in preparation for hitting the ball onto the driving range. The identification of the individual golf ball is obtained by tee area RFID reader 508 and sent to server 504 via a tee area network communications module 516 communicatively coupled to the tee area RFID reader 508. The communication of an RFID golf ball identification from the tee area network communications module 516 to the server 504 may occur when the ball is placed on the tee (on arrival at the tee area), or when the ball is hit off of the tee (on departure from the tee area). In some embodiments, the identification of the RFID golf ball is communicated when the ball is placed on the tee and again when it is hit from the tee area.

Yet another embodiment is directed to a method of embedding an RFID tag or an RFID chip into a multi-core golf ball. The above-listed methods of embedding an RFID tag into a single core golf ball may also be applied to the inner core of a multi-core golf ball. Further embodiments of embedding an RFID tag into a multi-core golf ball are described below.

FIG. 14 illustrates a cross sectional view of a multi-core golf ball 1000 in accordance with an embodiment. Golf ball 1000 includes a soft inner core 1002, with a hard outer core 1004 surrounding the soft inner core 1002. Multi-core golf balls may include one or more outer cores 1004. An optional casing layer 1006 (dashed outline) encases the outer core 1004. Finally, a dimpled cover 1008 (illustrated as the dotted outline) including dimples encases the casing layer 1006.

The choice of materials for the various layers of the multi-core golf ball result in the multi-core golf balls having different feels for different types of shots. For example, a multi-core golf ball may feel hard when hitting it off the driver, yet feel soft when hit around the green due to the golf swing speed. It is to be understood that the selection of the materials for the inner core, the outer core, and the various other layers of the multi-core golf ball are well known in the art, and any combination of multi-core golf ball materials may be used with embodiments described herein.

FIG. 15A illustrates a cross-sectional view of inner core 1002 in accordance with an embodiment. The inner core 1002 includes a cylindrical cavity 1010 passing along the center of the inner core 1002 and whose length may be less than or equal to the diameter of the inner core 1002. The cylindrical cavity 1010 can be formed by molding the inner core 1002, where the pattern creates the spherical inner core 1002 along with the cavity 1010. An RFID tag 1020 may then be inserted into the cylindrical cavity 1010.

In one embodiment, the RFID tag 1020 is an RFID tag with a flexible substrate, and the RFID tag 1020 can be rolled into a cylinder or a ball by wrapping the RFID tag several times around itself. The rolled RFID tag may then be inserted into the cylindrical cavity 1010. The RFID tag 1020 may also be folded, curved, or bent into a substantially curved shape that can fit within the cylindrical cavity 1010. The RFID tag 1020 may also be inserted into the cylindrical cavity 1010 without rolling or bending the RFID tag.

After the RFID tag 1020 is inserted into the cavity 1010 of the inner core 1002, the cavity 1010 may be sealed or filled with a fill material to fill any gaps in the cavity 1010. The one or more outer cores 1004 may also be formed without sealing or filling the cavity 1010.

RFID tag has a substantially rectangular shape. RFID tag 1020 includes an integrated circuit (IC) 1022 and an antenna 1024. RFID tag 1020 is an illustrative embodiment, as any type and shape of RFID tag may be embedded within a golf ball, size permitting. The RFID tag may include a flexible substrate, allowing the RFID tag to be rolled and folded. Alternatively, the RFID tag may include a non-flexible substrate, with the RFID tag embedded within the inner core 1002 without bending or folding the RFID tag.

FIG. 15B illustrates a cross-sectional view of the inner core 1002 and outer core 1004, with the RFID tag 1020 positioned to interface with the exterior surface of the inner core 1002. The RFID tag 1020 can be draped over the exterior surface of the inner core 1002 or otherwise positioned along the surface of the inner core. Thus, rather than molding a cavity within inner core 1002 or drilling a cavity within inner core 1002, the RFID tag 1020 can be positioned on the exterior surface of the inner core 1002 without modification to the inner core 1002. The outer core 1004 can then be molded to encase the RFID tag between the inner surface of the outer core 1004 and the exterior surface of the inner core 1002.

In one embodiment, an encapsulated RFID tag 1030 may be positioned to interface with the exterior surface of the inner core 1002, as illustrated in FIG. 15B. The encapsulated RFID tag 1030 can be draped over or otherwise positioned along the exterior surface of the inner core 1002, with the outer core 1004 molded to encase the encapsulated RFID tag and the inner core 1002. In one embodiment, the encapsulated RFID tag includes an RFID tag 1032 positioned within a rigid or elastic package 1034. The package 1034 can be made of a rigid material, such as epoxy, or a flexible and elastic material, such as PVC, Teslin, urethane, or any such flexible material. The empty space 1036 between the RFID tag 1032 and the package 1034 can be filled with a fluid or soft material that provides a cushioned protection for the RFID tag 1032. The empty space 1036 can also be left empty or filled with air or some other gas, to provide cushioning of the RFID tag 1032.

In yet another embodiment, the RFID tag 1020 or the encapsulated RFID tag 1030 may be positioned within a molded impression on the exterior surface of the inner core 1002. Molded impressions on the surface of the inner core 1002 were described above in reference to at least FIGS. 11A and 11B.

FIGS. 16A-16C illustrate the rectangular RFID tag 1020 folded into a curved RFID tag 1050. FIG. 16A illustrates a perspective view of the curved RFID tag 1050;

FIG. 16B illustrates a side, cross-sectional view of the curved RFID tag 1050; and FIG. 16C illustrates a side, cross-sectional view of the curved RFID tag 1050 bent further. The curved RFID tag 1050 is curved or folded into a substantially U shape, enabling the curved RFID tag 1050 to be easily inserted into smaller cavities. The curved RFID tag 1050 may be curved by various methods, such as by folding up opposite ends of the RFID tag.

The RFID tag may be folded lengthwise or widthwise. The RFID tag may be folded slightly, as illustrated in FIGS. 16A and 16B. This type of folding leaves a wide open area 1052 in the middle of the RFID tag 1052. The RFID tag may also be folded more extensively, such that the opposite ends of the curved RFID tag touch each other or almost touch teach other, as illustrated in FIG. 16C.

The curved folding illustrated in FIG. 16 can be described in terms of degrees (between 0 and 360). An RFID tag bent at 0 degrees would consist of a flat RFID tag without any folding, such as RFID tag 1020. FIG. 16C illustrates the curved RFID tag 1050 bent at almost 360 degrees, resulting in the opposite ends of the RFID tag almost touching each other and forming a substantially cylindrical shape.

FIGS. 17A-C illustrate the RFID tag 1020 rolled into a rolled RFID tag 1060 in accordance with an embodiment. FIG. 17A illustrates a side view of the rolled RFID tag 1060 rolled into a substantially cylindrical shape. The rolled RFID tag may be rolled by wrapping the RFID tag several times around itself. FIG. 17B illustrates a front view of the rolled RFID tag 1060 a loosely wrapped around itself, where a first end 1062 of the rolled RFID tag 1060 is rolled once past the second end 1064 of the rolled RFID tag 1060. FIG. 17C illustrates the rolled RFID tag 1060 more tightly wound, with the first end 1062 of the rolled RFID tag 1060 rolled twice past the second end 1064. Similar to the curved RFID tag 1050, rolling the RFID tag results in the rolled RFID tag 1060 forming an empty space 1066 in the middle of the rolled RFID tag 1060.

The rolled RFID tag 1060 may be rolled lengthwise or widthwise. The rolled RFID tag 1060 may be rolled one or more times around itself. Finally, the rolled RFID tag 1060 may be rolled in a substantially cylindrical shape, into a ball, or into some other shape.

In one embodiment, the empty space 1052 and 1066 formed by the folding of the RFID tag 1050 or the rolling of the rolled RFID tag 1060 may be filled with a filling material, with the same core material as the inner core 1002, or a different core material may be used to fill the empty space 1052. The curved or folded RFID tag 1050 may be filled with a core material prior to inserting the RFID tag into the cavity of the inner core. The curved RFID tag 1050 may be curved and folded around the core material by wrapping the curved RFID tag 1050 around the core material, and subsequently the curved RFID tag 1050 may be inserted into the cavity of the inner core. Similarly, the rolled RFID tag 1060 may be rolled around the core material, and subsequently inserted into the cavity.

In one embodiment, core material may be injected into the empty space 1052 and 1066 after the RFID tag has been inserted into the cavity of the inner core 1002. In addition to filling the empty space 1052 and 1066, additional core or filling material may be added or injected into cavity 1010 to fill any gaps within cavity 1010 and to fill any gaps between the RFID tag and the walls of cavity 1010.

It is to be understood that the empty space 1052 and 1066 may be left empty, and it need not be filled as described above.

Figure 18A:
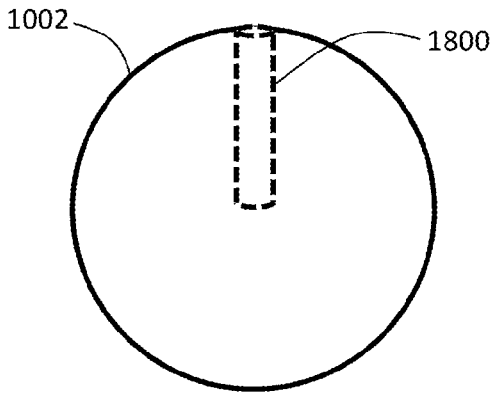
Figure 18B:
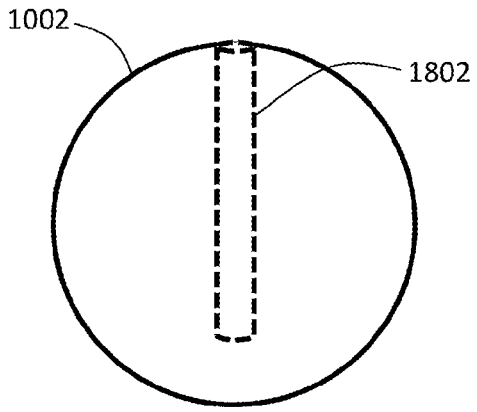

FIGS. 18A-18D illustrate cross sectional view of inner core 1002 with differently sized and shaped cavities for receiving the RFID tag. FIGS. 18A and 18B illustrate two cavities that differ in length. Cavity 1800 has a length equal to about the radius of the inner core 1002, and it is formed from the center of the inner core 1002 to the edge of the inner core 1002. Cavity 1802 has a length greater than the radius of the inner core, and it is spans about three quarters of the diameter of the inner core 1002. The length, width, shape, and other dimensions of the cavity may be varied without departing from the spirit of embodiments. For instance, while the cavity is not limited to being cylindrical, as the cavity may be rectangular shaped, triangular shaped, polygonal shaped, asymmetrical shaped, etc.

Figure 18C:
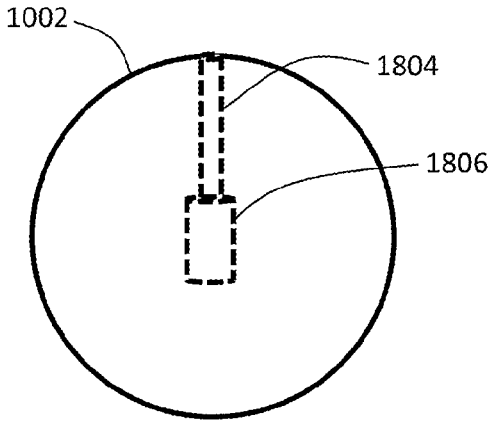
Figure 18D:
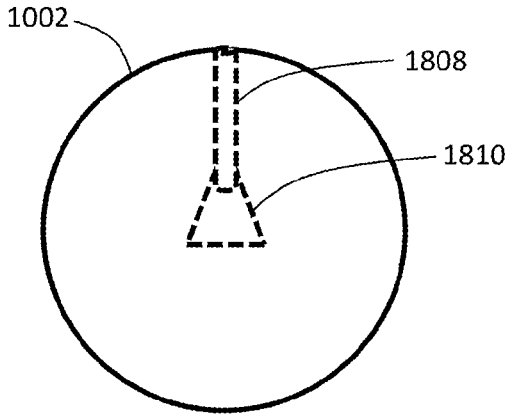

FIG. 18C illustrates a cavity formed by two differently sized and shaped chambers. The cavity includes a first cylindrical chamber 1804 and a second cylindrical chamber 1806. The first cylindrical chamber 1804 has a length that is greater than the second cylindrical chamber 1806, while the second cylindrical chamber 1806 has a greater diameter than the first cylindrical chamber 1804. FIG. 18D illustrates yet another embodiment of a cavity consisting of a first cylindrical chamber 1808 and a second triangular shaped chamber 1810.

In FIGS. 18C and 18D, the first cylindrical chamber serves as a delivery passage to the second larger chamber. For example, the RFID tag may be rolled or folded to fit within the first cylindrical chambers 1804 or 1808. The RFID tag may then be pushed through the first cylindrical chambers 1804 or 1808, until the RFID tag is positioned within the larger second cylindrical chambers 1806 or 1810. The larger second cylindrical chambers 1806 and 1810 may be sized and shaped to allow the RFID tag to fully or partially unfold or unroll. While FIGS. 18C and 18D illustrate the cavities consisting of a first chamber and a second chamber, alternative embodiments may consist of two or more differently sized and shaped chambers. The first chamber need not be smaller nor have a smaller diameter than the second chamber. Finally, the size of the first chamber, the second chamber, or any other chamber forming the cavity of the inner core may have various shapes, including a cylindrical shape, a polygonal shape, a rectangular shape, a triangular shape, an asymmetric shape, a sphere shape, etc.

FIGS. 19A-19D illustrate a top view of inner core 1002 with differently shaped and sized cavities in accordance with an embodiment. As FIG. 19 is a top view, each of the figures illustrates the opening of the corresponding cavity. It is noted that the cavity shape need not be the same size and shape as the size and shape of the opening for the cavity. For example, a rectangular cavity may have a circular opening; a cylindrical cavity may have a rectangular opening, etc. The opening of the cavity may be made smaller to prevent the RFID tag from coming out of the cavity after the RFID tag has been inserted into the cavity of the inner core.

The shape of the opening may be a plurality of shapes as illustrated in FIG. 19, including a circular shape, a rectangular shape, a polygonal shape, a free-form or asymmetrical shape, etc. FIG. 19A illustrates the opening for a cylindrical cavity with a circular opening 1900. FIG. 19B illustrates the inner core 1002 with a rectangular opening 1902 for a rectangular cavity. FIG. 19C illustrates a top view of inner core 1002 with a slot opening 1904 having a substantially rectangular slot shape. While openings 1900 and 1902 enable the insertion of RFID tags with or without rolling and folding of the RFID tag, the slot opening 1904 is meant for the insertion of a rectangular RFID tag without deformation of the RFID tag.

Figure 19A:
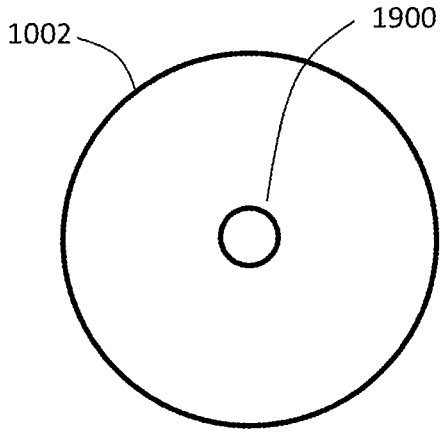
Figure 19B:
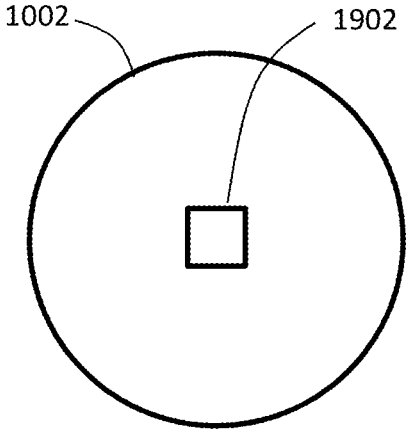
Figure 19C:
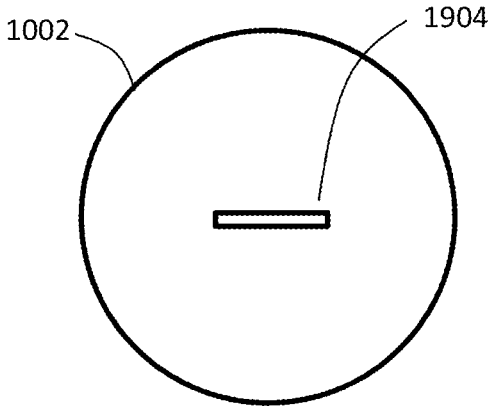
Figure 19D:
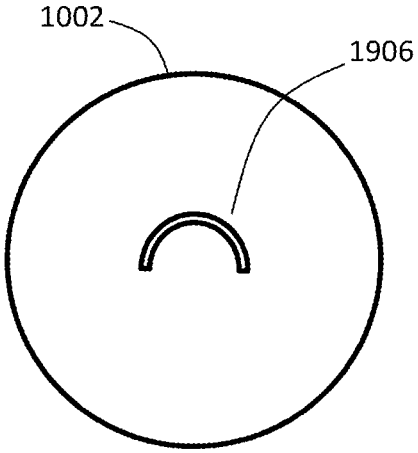
Figure 19E:
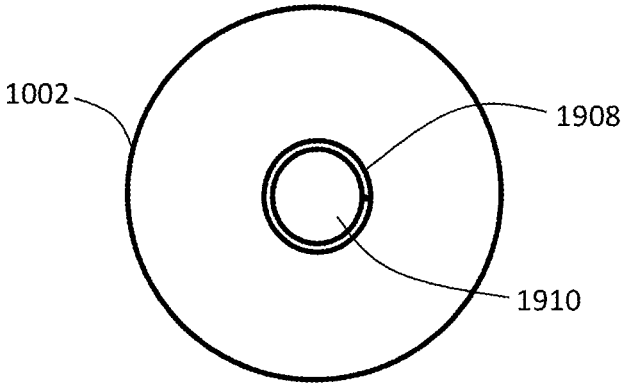

FIG. 19D illustrates a top view of inner core 1002 with a circular slot opening 1906. While the circular slot opening 1906 is illustrated as a half circle, the circular slot opening 1906 may be shaped and sized to be longer and wider. For instance, the circular slot opening may be an arc with a degree of up to 360 degrees. FIG. 19E illustrates a circular slot opening 1908, leaving a solid center 1910 on the inner core 1002.

The cavity of the inner core may be formed by drilling the inner core. The drilling may be performed after the slugs are melted into spherical cores. The cavity may also be formed by molding the inner cores to include a cavity. The pattern of the mold for the inner cores can include an inner mold element forming the inner cavity. For example, FIGS. 7E, 8C, and 8D, illustrate three different inner mold elements which are part of the pattern for the mold for the inner core, which forms differently shaped cavities for the inner mold. Thus, different shaped and sized cavities may be molded by switching the inner mold element.

FIG. 20A illustrates a flowchart illustrating a set of steps for fabricating a multi-core golf ball, with an embedded RFID tag, in accordance with an embodiment. As described above, the core material of the inner core is fabricated from a slug. The slug may be a processed rubber that has been extruded and cut into a cylinder shape (or an alternative shape). The size of the slug may be dependent on the core material properties and based on the size requirements for the inner core. The inner core material is often rubber or a thermoplastic resin.

The method begins at block 2002 where the extruded and cut slugs are placed in a tray including a plurality molds, such as the molds illustrated in FIGS. 7E, FIG. 8C, and FIG. 8D. As the trays are forced together, the slugs are molded and baked into sphere-shaped cores, as indicated at block 2004. The resulting inner cores include a cavity formed within the inner core. At block 2006, the RFID tag is folded or rolled, and at block 2008 the RFID tag is inserted into the inner core cavity. The folding or rolling of the RFID tag is an optional step, as the RFID tag may be inserted within the cavity without folding or rolling the RFID tag. At block 2010, the inner core is sealed or filled to fill any gaps remaining within the inner core cavity. At block 2012, the one or more outer cores are formed. At block 2014, the casing layer and the dimpled cover are formed.

The mold tray can consist of a lower tray and an upper tray. Each of the lower tray and the upper tray includes a plurality of molds consisting of a hollowed-out hemisphere shapes. While lower trays and upper trays with hollowed-out hemisphere shapes are described, alternative mold trays may consist of molds that are more or less hemispheres.

The inner core material is placed in the lower tray, and either the lower tray is raised or the upper tray is lowered, such that the lower tray and the upper tray encase the core material within each mold. Each mold may include a rigid frame or model which sets the pattern for the cavity and the opening of the cavity. The model of each model may then set the pattern for a cylindrical cavity, or a rectangular cavity, a rectangular slot, a circular slot, a cavity with differently sized and shaped chambers, etc. After the RFID tag is embedded within the inner core, the molding of the one or more outer cores, the casing layer, and the cover may then be formed.

FIG. 20B illustrates a flowchart 2030 with an alternative set of steps for embedding an RFID tag within the inner core of a multi-core golf ball. Flowchart 2030 differs from flowchart 2000 in steps 2032 and 2034. In step 2032, the extruded slugs are placed in a spherical core mold that does not include a pattern for forming the inner core cavity for receiving the RFID tag. After the slugs are melted into spherical cores in step 2004, the inner core is drilled to form the cavity for receiving the RFID tag in step 2034. The rest of the steps 2006-2014 consist of inserting the RFID tag within the cavity, and forming the rest of the multi-core golf ball.

As noted above, a plurality of RFID tags may be embedded within single core and multi-core golf balls. FIGS. 1A-1D and FIG. 15 illustrate examples of RFID tags that may be used with the embodiments described herein. FIGS. 21A-21C illustrate further examples of RFID tags may be embedded within single core and multi-core golf balls.

FIG. 21A a top down view of an RFID tag 2100 having a substantially peanut-shaped substrate. The RFID tag 2100 includes an integrated circuit 2102 and an antenna 2104. FIG. 21B illustrates yet another embodiment of an RFID tag 2110 having a substantially oval shaped substrate. RFID tag 2110 includes an integrated circuit 2112 and an antenna 2114. Similar to RFID tag 2100, the oval shaped substrate minimizes signal absorption and minimizes signal loss due to the folding or bending of RFID tag 2110.

In one embodiment, the antenna may be configured as a dampened waveform, in which the amplitude of the sinusoidal waves decrease as a function of the distance from the integrated circuit. In yet another embodiment, the antenna may be configured as a waveform, in which the amplitude of the sinusoidal waveforms remains constant as a function of the distance from the integrated circuit.

FIG. 21C illustrates an embodiment of an RFID chip 2120 which may also be embedded within single core and multi-core golf balls. The RFID chip 2120 is substantially pill shaped, and it includes an integrated circuit 2122, and an antenna 2124 comprised of a coil coupled to the integrated circuit 2122. The benefit of the RFID chip 2120 is that the RFID chip is encased within a case, which may be made from various materials (such as epoxy, glass, etc.). The case would then protect the antenna and the chip of the RFID tag after the cavity is filled with core material to seal the cavity. The RFID chip can also readily fit within cylindrical shaped cavities without having to deform the shape of the RFID chip.

In yet another embodiment, the inner core of a multi-core golf ball may be split in half, the RFID tag may be sandwiched between the top hemisphere and the bottom hemisphere, and the top and bottom hemispheres are melted together into a single inner core with the embedded RFID tag. While the forming of a compressible inner core from the top hemisphere and the bottom hemisphere is described in terms of reheating and melting the top hemisphere and the bottom hemisphere within a mold, alternative methods of fusing the hemispheres into a single inner core may also be performed without departing from the spirit of embodiments. Thus, any method of fusing, joining, uniting, or blending the top hemisphere with the bottom hemisphere may be performed in accordance with embodiments described herein. Following the formation of the inner core with the embedded RFID tag, the rest of the manufacturing process to manufacture the multi-core golf ball may be performed, including the forming of the one or more outer cores and the dimpled cover.

Figure 22A:
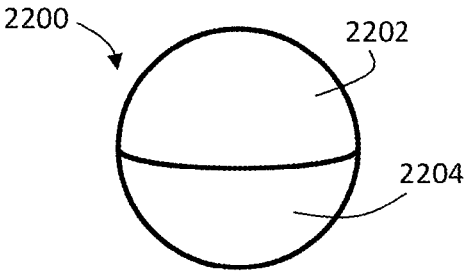
Figure 22B:
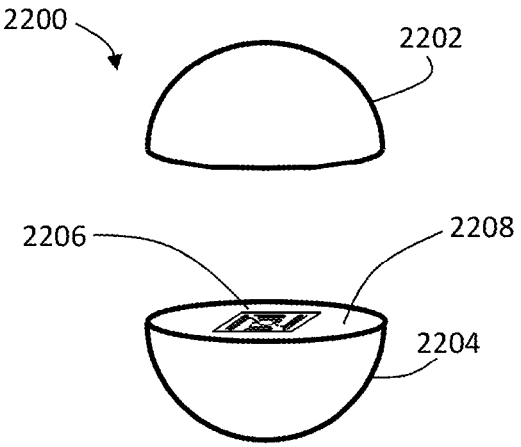

FIG. 22A illustrates a split inner core 2200 including a top hemisphere 2202 and a bottom hemisphere 2204. FIG. 22B illustrates the top hemisphere 2202 separated from the bottom hemisphere 2204, with an RFID tag 2206 placed on the flat surface 2208 of the bottom hemisphere 2204. The top and bottom hemispheres are then melted together, with the newly pressed spherical compressible core encasing the RFID tag 2206.

The inner core of 2200 may be split into hemispheres, or it may be split into two unequal portions. For example, the inner core 2200 may be split into a top section and a bottom section, where the top section is smaller than the bottom section, or vice-versa. The top hemisphere 2202 and the bottom hemisphere 2204 are formed by cutting the inner core sphere along a plane through the center of the sphere. However, if the cutting plane does not go through the center of the sphere, the sphere is cut into a top section and a bottom section with unequal volumes, as illustrated in FIG. 22E. Finally, the cutting of the inner core need not be along a plane. The cut splitting the inner core may be irregular and asymmetric. The terms first inner core section and second inner core section are also used in this specification to refer to the two inner core sections resulting from splitting or cutting the inner core 2200 as described herein.

In one embodiment, the top hemisphere and the bottom hemisphere may not include a middle cavity for fitting the RFID tag 2206, as illustrated in FIG. 22B. The RFID tag 2206 can then be placed in the middle of the hemispheres by placing the RFID tag on the flat surface of the top hemisphere or the flat surface of the bottom hemisphere. The hemispheres with the sandwiched RFID tag 2206 can be placed in a mold to form a newly pressed inner core with the embedded RFID tag.

Figure 22C:
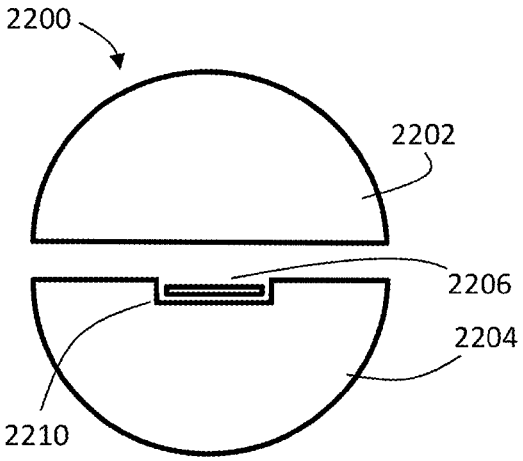
Figure 22D:
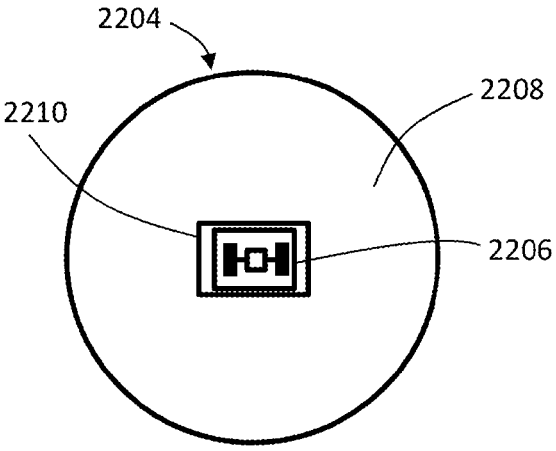
Figure 22E:
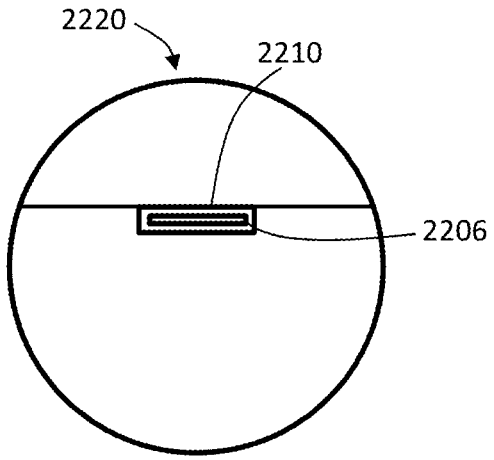

FIG. 22C illustrates a cross-sectional view of a split inner core having a middle cavity 2210 on the bottom hemisphere for fitting the RFID tag 2206. FIG. 22D illustrates a top down view of bottom hemisphere 2204 with the RFID tag 2206 positioned within the middle cavity 2210. The middle cavity may be molded during the molding of the inner core, similar to the molding of the cavity for receiving the RFID tag described in reference to at least FIG. 15. In addition, the middle cavity may be formed after the inner core is split. The middle cavity can be formed by using a cutting device or a drilling device.

As discussed above, the middle cavity 2210 may be formed on the top hemisphere, the bottom hemisphere, or on both the top and bottom hemisphere. It is also possible for the top hemisphere to include a cavity which fits only a portion of the RFID tag, and the bottom hemisphere to include a complimentary cavity which first the rest of the RFID tag. Thus, the middle cavity 2210 may be formed according to various sizes and shapes. In FIG. 22D, the middle cavity is illustrated as being substantially rectangular shaped. However, the middle cavity may be circular, oval, triangular, polygonal, asymmetric, or some other shape. The length, width, and depth of the middle cavity may also be varied depending on the size and shape of the RFID tag being embedded in the inner core, among other factors. For example, the middle cavity can be specifically sized to match the exact dimensions of the RFID tag to be embedded in the inner core. Alternatively, the middle cavity may be sized slightly larger in order to accommodate differently shaped and sized RFID tags.

In an embodiment, the middle cavity may have an area or size smaller than the RFID tag, requiring the RFID tag to be rolled or folded to fit within the middle cavity, as described in reference to at least FIGS. 15-20.

Figure 22F:
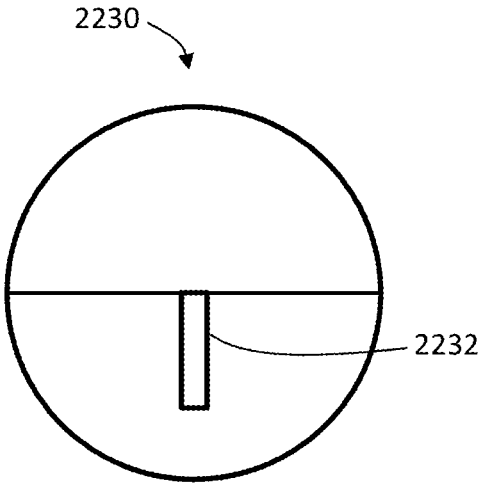
Figure 22G:
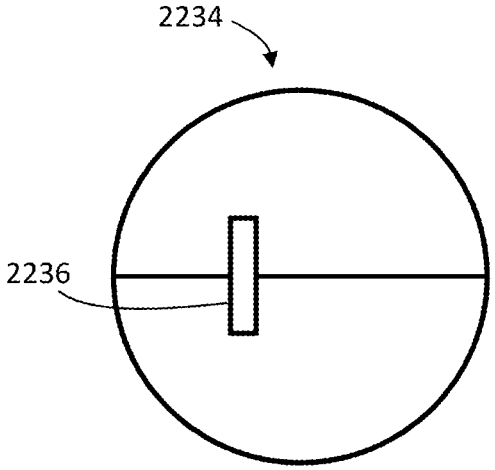

FIGS. 22F and 22G illustrate split inner cores 2230 and 2234 with substantially vertical, middle cavities 2232 and 2236, respectively. The vertical, middle cavities 2232 and 2236 are oriented perpendicular to the substantially horizontal, middle cavities of FIGS. 22C-22E. The middle cavity can thus be formed oriented along a plurality of angles, and the middle cavity need not be positioned within the center of the hemispheres. The middle cavities may also be formed according to the various shapes and types described in reference to FIGS. 15, 18, and 19.

In one embodiment, the middle cavity can be fully or partially filled or sealed with a filling or with a core material. Filling the middle cavity fills any empty spaces between the RFID tag and the middle cavity. The core material may be the same material used for the inner core, or some alternative core material. The filling of a cavity after inserting the RFID tag was described in detail above.

Referring to FIGS. 9A-9C, there is shown various RFID tags that can be sandwiched between split compressible cores as shown in FIG. 9D. The embodiments illustrated and discussed in reference to FIGS. 9A-9D may also be used with the split inner core of a multi-core golf ball.

In one embodiment, the RFID tag may include one or more conductive wires coupled to the integrated circuit of the RFID tag, with the one or more conductive wires acting as the antenna for the RFID tag. For example, FIG. 1C illustrates an encapsulated RFID tag 20 with conductive wires 30 and 32 coupled to the integrated circuit of the RFID tag 20, which operate as an antenna. In the present embodiment, the RFID tag can be positioned between the top hemisphere and the bottom hemisphere, and the conductive wires can be wrapped around the exterior surface of both hemispheres. The conductive wires can also be wrapped around only the top hemisphere, around only the bottom hemisphere, or around both the top and the bottom hemispheres. The conductive wires or antennas may be a single wire or a plurality of stranded wires. The plurality of stranded wires may be braided wire which lessens the chance for a fatigue failure of a single-wire antenna.

FIG. 23A illustrates split inner core 2200 with the conductive wires 2250 of RFID tag wrapped around the exterior surface of the split inner core 2200. While FIG. 23A illustrates the conductive wires 2250 wrapped substantially uniformly around the exterior surface of the split inner core 2200, the conductive wires 2250 may be wrapped in any particular pattern around the split inner core 2200. FIG. 23B illustrates split inner core 2200 with conductive wires 2250 wrapped around the top hemisphere of the split inner core. FIG. 23C illustrates split inner core 2200 with conductive wires 2250 wrapped around the bottom hemisphere of the split inner core. Finally, the particular pattern used to wrap the split inner core may also result in the conductive wires 2250 being partially wrapped around the top hemisphere and partially wrapped around the bottom hemisphere.

Wrapping of the conductive wires can be performed using various techniques. The conductive wires 2250 can be wrapped either before or after the top hemisphere and the bottom hemisphere are melted into a newly formed inner core. When wrapping the conductive wires around both the exterior of the top and bottom hemisphere, the conductive wires need not be threaded through the middle of the hemispheres. However, it is also possible to thread the conductive wires through the middle of the hemispheres, or to place the distal end of the conductive wires on the middle of the hemispheres (sandwiched along with the RFID tag). When wrapping the conductive wires around a single hemisphere, the conductive wires can be wrapped around both the circumference of the hemisphere and around the flat surface of the hemisphere. It is also possible to form an intertwined pattern around the top and bottom hemispheres, such that one loop of the conductive wires is wrapped around the top hemisphere, the conductive wires are then passed through the middle of the hemispheres, and the next loop of the conductive wires is wrapped around the bottom hemisphere, and so on. Such wrapping pattern would then result in the conductive wires forming a substantially figure-eight pattern. It is to be understood that the conductive wires may be wrapped around the exterior of the hemisphere(s) using various patterns without departing from the spirit of embodiments.

In one embodiment, the inner core may be formed by molding a top hemisphere and molding a bottom hemisphere, rather than molding an inner core that needs to be split. A plurality of top half and bottom half inner cores may be molded by using trays including a plurality of hemisphere domes. The mold pattern for these hemispheres may also include a pattern forming a cavity within the hemispheres. The molded hemispheres may then be melted, as discussed above, into a single inner core with the embedded RFID tag.

In yet another embodiment, a slug as shown in FIG. 7E may be split into two sections and the RFID tag can be sandwiched between the two slug sections. The split slug with the sandwiched RFID tag may then be placed in a mold that is heated to form an inner core with an embedded RFID tag.

FIG. 24 illustrates a flowchart 2400 of the various steps for fabricating a multi-core golf ball, with an RFID tag embedded in a split inner core, in accordance with an embodiment. In step 2402, the extruded and cut slugs are placed in a tray including a plurality of spherical molds. For example, at least FIG. 7E and FIG. 8 illustrate example molds. As the trays are forced together, the slugs are molded and baked into sphere-shaped inner cores, as indicated at step 2404. In step 2406, the inner cores are split in half or split in some other way as described above. In step 2408, an RFID tag is sandwiched between the two halves of the split core. In step 2410, the bottom hemisphere, the top hemisphere, and the RFID tag (positioned in the middle of the hemispheres) are inserted into a spherical core mold. In step 2412, the hemispheres are melted for a second time to bond the inner core halves together and trap the RFID tag within the inner core. In step 2414, the inner cores containing RFID tags then placed in various molds in order to form the one or more outer cores, the casing layer, and the dimpled cover.

Yet another embodiment is directed to embedding an RFID tag in a multi-core golf ball. The present embodiment is directed to RFID tags using conductive wires as the antennas. The RFID tag is embedded within a split inner core. The split inner core includes features molded on the exterior surface of the split inner core that facilitate the wrapping of the conductive wires around the split inner core. The plurality of grooves may also be formed with a drilling device, a cutting device, a chiseling device, or some other device.

FIG. 25 illustrates a cross-sectional view split inner core 2500 with a plurality of grooves 2502 molded or formed on the exterior surface of the split inner core 2500. An RFID tag

2504 is embedded within a middle cavity 2506 formed between the top hemisphere and the bottom hemisphere of split inner core 2500. The conductive wires (not shown) of RFID tag 2504 are wrapped around the inner core 2500 by running the conductive wires through the plurality of grooves 2502. The plurality of grooves 2502 may consist of a single groove that wraps around the circumference of the inner core multiple times, forming the plurality of grooves. Alternatively, a series of separate and disconnected grooves may be formed along the exterior surface of the split inner core 2500. The inner core 2500 may also include horizontal connecting grooves 2508, as illustrated in FIG. 25B, which serve as connecting paths between two grooves to enable the conductive wires to be threaded between two or more grooves.

When wrapping the conductive wires along the grooves, the conductive wires need not be wrapped around all of the grooves. For instance, the conductive wire may be wrapped multiple times along a single groove or along one or more grooves out of the plurality of grooves. As another example, the conductive wires may be wrapped twice around a first groove, and once around a second groove. Thus, the grooves can be used as a guide to form a plurality of wrapping patterns around the exterior surface of the split inner core 2500.

The split inner core may be molded to have horizontal grooves as illustrated in FIG. 25C. The split inner core may also be molded to include both horizontal grooves and vertical grooves. Overall, a plurality of groove patterns may be molded on the exterior surface of the split inner core to facilitate the wrapping of the conductive wires.

In one embodiment, the split inner core may have molded grooves with different dimensions. For instance, the grooves near the center of the inner core may be deeper and/or wider than the grooves far from the center of the inner core. The spacing between the grooves may also vary along the exterior surface of the split inner core. Finally, while the grooves are illustrated as being substantially straight, the grooves may also be shaped to meander along the exterior surface of the inner core. Other properties of the grooves that can be varied by changing the mold pattern include the width of the grooves, the depth of the grooves, the numbers of grooves, the pattern of the grooves, etc.

In FIGS. 25A-C, the grooves on the top hemisphere of the inner core align with the grooves on the bottom hemisphere of the inner core. In other embodiments, the grooves may be molded so that the top hemisphere includes a different pattern of grooves than the bottom hemisphere. The top hemisphere may also be molded without grooves and the bottom hemisphere may be molded with grooves, and vice-versa.

FIG. 26A illustrates a cross-sectional view of another embodiment of a split inner core 2600 with molded features on the exterior surface. The split inner core 2600 includes a plurality of grooves 2602 and a termination point 2604 for securing the distal end 2606 of the conductive wires acting as the antenna of the RFID tag 2608. After the conductive wires are wrapped along the plurality of grooves 2602, the distal end 2606 of the conductive wires may be anchored against the edges of the termination point 2604. The termination point 2604 is substantially wedge shaped, but may also be shaped in some other fashion. The inside surface of the termination point 2604 may also include grooves or indentations enabling the distal end 2606 of the conductive wires to be secured without coming loose.

In one embodiment, the distal end 2606 of the conductive wires may be rolled into a coil, with the coil inserted within termination point 2604.

FIG. 26B illustrates an alternative termination point 2604 including an opening 2610 which is smaller than the wider section of the termination point 2604. The smaller opening 2610 helps to secure the distal tip 2606 of the conductive wires and it prevents the conductive wires from simply falling out of the termination point 2604.

The plurality of grooves may also be molded on inner cores including a molded cavity or a drilled cavity as described in reference to FIGS. 15-20. For example, in reference to FIG. 15, an RFID tag with conductive wires may be inserted within cavity 1010 of inner core 1002. The conductive wires can be pulled out of the open end(s) of the cavity 1010. The conductive wires can then be wrapped around the inner core 1002 along the plurality of grooves formed on the exterior surface of the inner core.

It is to be understood that the detailed description of illustrative embodiments are provided for illustrative purposes. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A multi-core golf ball, comprising:
- a spherical inner core;
- an RFID tag configured for insertion into the spherical inner core, the RFID tag including:
  - a plurality of contact pads;
  - a first plurality of conductive stranded wires electrically coupled to the contact pads;
  - a second plurality of conductive wires electrically coupled to the first plurality of conductive stranded wires, each wire in the second plurality of conductive wires having a thickness that is greater than each wire in the first plurality of conductive stranded wires;
- an outer core configured to encapsulate the spherical inner core and the RFID tag; and
- a dimpled cover configured to encase the spherical inner core, the RFID tag and the outer core.

2. The multi-core golf ball of claim 1, wherein the spherical inner core includes a molded surface configured to receive the RFID tag.

3. The multi-core golf ball of claim 1, wherein the spherical inner core has a cavity configured to receive the RFID tag.

4. The multi-core golf ball of claim 3, wherein the RFID tag is shaped to conform to the cavity.

5. The multi-core golf ball of claim 3 wherein the cavity has a shape and the RFID tag is formed to fit into the cavity shape.

6. The multi-core golf ball of claim 1, further comprising a filling material sealing empty space within the cavity between the RFID tag and the cavity.

7. A multi-core golf ball, comprising:
- a spherical inner core including a cavity;
- an RFID tag configured for insertion into the cavity of the spherical inner core;
- the RFID tag further including:
  - a plurality of contact pads;

a first plurality of conductive stranded wires electrically coupled to the contact pads;

a second plurality of conductive wires electrically coupled to the first plurality of conductive stranded wires, each wire in the second plurality of conductive wires having a thickness that is greater than each wire in the first plurality of conductive stranded wires;

an outer core configured to encapsulate the spherical inner core and the RFID tag; and a dimpled cover configured to encase the spherical inner core, the RFID tag and the outer core.

8. The multi-core golf ball of claim 7, wherein the plurality of stranded wires are wrapped around an exterior surface of the spherical inner core.

9. The multi-core golf ball of claim 7 wherein the RFID tag further comprises an antenna portion disposed on a substrate, wherein the substrate is configured to fit into the cavity.

10. The multi-core golf ball of claim 7, wherein the RFID tag is curled to fit into the cavity.

11. The multi-core golf ball of claim 7, wherein the RFID tag is folded to fit into the cavity.

12. The multi-core golf ball of claim 7, further comprising a filling material configured to seal the cavity containing the RFID tag.

13. A method for embedding an RFID tag in an inner core of a multi-core golf ball, comprising:

placing a slug into a mold, the mold including a pattern forming a spherical inner core configured to receive the RFID tag, the RFID tag including:

a plurality of contact pads;

a first plurality of conductive stranded wires electrically coupled to the contact pads;

a second plurality of conductive wires electrically coupled to the first plurality of conductive stranded wires, each wire in the second plurality of conductive wires having a thickness that is greater than each wire in the first plurality of conductive stranded wires;

melting the slug within the mold into the spherical inner core, wherein the spherical inner core has a cavity configured to receive the RFID tag;

rolling the RFID tag; and placing the rolled RFID tag within the cavity.

14. The method of claim 13, wherein the spherical inner core includes a molded surface configured to receive the RFID tag.

15. The method of claim 13, wherein the mold forms the cavity.

16. The method of claim 13, further comprising the step of forming the cavity with a drilling device.

17. The method of claim 13, further comprising the step of filling the cavity with a core material.

* * * * *